US011658401B2

(12) United States Patent
Deng et al.

(10) Patent No.: US 11,658,401 B2
(45) Date of Patent: May 23, 2023

(54) ANTENNA APPARATUS AND TERMINAL

(71) Applicant: Huawei Technologies Co., Ltd., Shenzhen (CN)

(72) Inventors: Shaogang Deng, Dongguan (CN); Qing Liu, Shenzhen (CN); Wei Chen, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 59 days.

(21) Appl. No.: 17/056,253

(22) PCT Filed: May 13, 2019

(86) PCT No.: PCT/CN2019/086635
§ 371 (c)(1),
(2) Date: Nov. 17, 2020

(87) PCT Pub. No.: WO2019/218966
PCT Pub. Date: Nov. 21, 2019

(65) Prior Publication Data

US 2021/0218133 A1 Jul. 15, 2021

(30) Foreign Application Priority Data

May 18, 2018 (CN) ..... 201810481642.6

(51) Int. Cl.
*H01Q 1/36* (2006.01)
*H01Q 5/307* (2015.01)
(Continued)

(52) U.S. Cl.
CPC ..... *H01Q 1/36* (2013.01); *H01Q 1/3275* (2013.01); *H01Q 1/48* (2013.01); *H01Q 5/307* (2015.01);
(Continued)

(58) Field of Classification Search
CPC ..... H01Q 1/36; H01Q 1/3275; H01Q 1/48; H01Q 5/307; H01Q 9/32; H01Q 19/021; H01Q 5/392
See application file for complete search history.

(56) References Cited

U.S. PATENT DOCUMENTS 5,539,420 A 7/1996 Dusseux et al.
6,188,366 B1 2/2001 Yamamoto et al.
(Continued)

FOREIGN PATENT DOCUMENTS

CN 1244053 A 2/2000
CN 1615561 A 5/2005
(Continued)

OTHER PUBLICATIONS

Almalkawi, M., "High Gain Circularly Polarized Wire Antenna for DSRC Applications," International Journal of Electrical, Computer, Energetic, Electronic and Communication Engineering vol. 9, No. 6, 2015, 4 pages.
(Continued)

*Primary Examiner* — Andrea Lindgren Baltzell
*Assistant Examiner* — Yonchan J Kim
(74) *Attorney, Agent, or Firm* — Conley Rose, P.C.

(57) ABSTRACT

An antenna apparatus includes a ground plate, a radiator, and a signal source. The radiator is disposed on the ground plate. The signal source is configured to feed an electromagnetic wave signal of a first frequency band into the radiator. A first slot and a second slot are disposed on the ground plate. Both slots are closed slots and surround the radiator, and are used to restrain current distribution on the ground plate.

20 Claims, 45 Drawing Sheets

(51) Int. Cl.

| | |
|---|---|
| ***H01Q 1/32*** | (2006.01) |
| ***H01Q 1/48*** | (2006.01) |
| ***H01Q 9/32*** | (2006.01) |
| ***H01Q 19/02*** | (2006.01) |
| ***H01Q 5/392*** | (2015.01) |

(52) U.S. Cl.
CPC ..... *H01Q 5/392* (2015.01); *H01Q 9/32* (2013.01); *H01Q 19/021* (2013.01)

(56) References Cited

U.S. PATENT DOCUMENTS

| | | | | |
|---|---|---|---|---|
| 7,427,957 | B2 * | 9/2008 | Zeinolabedin Rafi | H01Q 19/005 343/770 |
| 2005/0083236 | A1 | 4/2005 | Louzir et al. | |
| 2005/0206573 | A1 | 9/2005 | Iigusa et al. | |
| 2005/0264462 | A1 * | 12/2005 | Yanagi | H01Q 9/40 343/773 |
| 2009/0303131 | A1 | 12/2009 | Schano | |
| 2011/0279342 | A1 * | 11/2011 | Takahashi | H01Q 9/40 343/845 |
| 2014/0071013 | A1 * | 3/2014 | Shtrom | H01Q 13/10 343/848 |
| 2017/0338552 | A1 | 11/2017 | Mao et al. | |
| 2020/0127388 | A1 * | 4/2020 | Hsiao | H01Q 21/20 |
| 2020/0328520 | A1 | 10/2020 | Deng | |

FOREIGN PATENT DOCUMENTS

| | | | | |
|---|---|---|---|---|
| CN | 102956968 | A | 3/2013 | |
| CN | 203134966 | U | 8/2013 | |
| CN | 103746177 | A | 4/2014 | |
| CN | 203674376 | U | 6/2014 | |
| CN | 104134859 | A | 11/2014 | |
| CN | 106329087 | A | 1/2017 | |
| CN | 106602230 | A | 4/2017 | |
| CN | 106415926 | B | 1/2021 | |
| EP | 1562259 | A1 * | 8/2005 | H01Q 1/242 |
| EP | 1562259 | A1 | 8/2005 | |
| EP | 1955406 | B1 | 7/2018 | |
| JP | 2001053530 | A | 2/2001 | |
| JP | 2005244302 | A | 9/2005 | |
| JP | 2005260365 | A | 9/2005 | |
| JP | 2013098763 | A | 5/2013 | |
| WO | 2005064745 | A1 | 7/2005 | |
| WO | 2017096420 | A1 | 6/2017 | |
| WO | 2017206074 | A1 | 12/2017 | |

OTHER PUBLICATIONS

ETSI GR NFV-IFA 015 V2.4.1, "Network Functions Virtualisation (NFV) Release 2; Management and Orchestration; Report on NFV Information Model," Feb. 2018, 14 pages.

* cited by examiner

~ TO FIG. 2e-2

CONT. FROM FIG. 2e-1

TO FIG. 2e-3

CONT. FROM FIG. 2e-2

~ TO FIG. 2f-2

CONT. FROM FIG. 2f-1

TO FIG. 2f-3

CONT. FROM FIG. 2f-2

~ TO FIG. 3f-2

CONT. FROM FIG. 3f-1

TO FIG. 3f-3

CONT. FROM FIG. 3f-2

~ TO FIG. 3g-2

CONT. FROM FIG. 3g-1

TO FIG. 3g-3

CONT. FROM FIG. 3g-2

~ TO FIG. 3h-2

CONT. FROM FIG. 3h-1

TO FIG. 3h-3

CONT. FROM FIG. 3h-2

~ TO FIG. 3i-2

CONT. FROM FIG. 3i-1

TO FIG. 3i-3

CONT. FROM FIG. 3i-2

~ TO FIG. 4f-2

CONT. FROM FIG. 4f-1

TO FIG. 4f-3

CONT. FROM FIG. 4f-2

~ TO FIG. 4g-2

CONT. FROM FIG. 4g-1

TO FIG. 4g-3

CONT. FROM FIG. 4g-2

TO FIG. 4h-2

CONT. FROM FIG. 4h-1

TO FIG. 4h-3

CONT. FROM FIG. 4h-2

TO FIG. 4i-2

CONT. FROM FIG. 4i-1

TO FIG. 4i-3

CONT. FROM FIG. 4i-2

ANTENNA APPARATUS AND TERMINAL

CROSS-REFERENCE TO RELATED APPLICATIONS

This application is a U.S. National Stage of International Patent Application No. PCT/CN2019/086635 filed on May 13, 2019, which claims priority to Chinese Patent Application No. 201810481642.6 filed on May 18, 2018. Both of the aforementioned applications are hereby incorporated by reference in their entireties.

TECHNICAL FIELD

The present invention relates to the field of communications antenna technologies, and in particular, to an antenna apparatus and a terminal.

BACKGROUND

Different from a personal mobile communications terminal, for a vehicle-mounted communications terminal product, a horizontal plane gain index of an antenna is a main index for measuring a vehicle-mounted antenna. In a known monopole antenna solution, when a size of the floor is infinite, a maximum radiation direction of the antenna is on a floor plane (referred to as a horizontal plane below). In actual application, the size of the floor cannot be infinite, therefore the maximum radiation direction of the antenna is tilted, and a gain on the horizontal plane is worse than that on the infinite floor.

SUMMARY

Embodiments of this application provide an antenna apparatus, to improve a radiation pattern of an antenna and increase a horizontal plane gain.

According to a first aspect, an embodiment of this application provides an antenna apparatus, including a ground plate, a radiator, and a signal source, where the radiator is disposed on the ground plate, the signal source is configured to feed an electromagnetic wave signal of a first frequency band into the radiator, a first slot and a second slot are disposed on the ground plate, both the first slot and the second slot are closed slots and surround the radiator, and the first slot and the second slot are used to restrain current distribution on the ground plate, so that a current generated by the electromagnetic wave signal of the first frequency band is confined in and around the first slot and the second slot.

The first slot and the second slot surrounding the radiator are disposed to prevent a current from flowing to an edge of the ground plate, and the current is confined in and around the first slot and the second slot, to change a radiation pattern of the radiator, so that a maximum radiation direction of the radiator moves towards a horizontal plane. This improves a horizontal plane gain of the radiator.

The first slot and the second slot are symmetrically disposed by using a joint between the radiator and the ground plate as a center. The first slot and the second slot that are symmetrically centered may enable that current distribution almost the same is generated on the ground plate around the radiator, so that shapes of radiation patterns of an antenna in all directions around the radiator are almost the same.

A radial distance from the radiator to the first slot ranges from $0.2x\lambda_1$ to $0.3x\lambda_1$, and $\lambda_1$ is a wavelength of the electromagnetic wave signal of the first frequency band. The distance between the first slot and the radiator is set to $0.2x\lambda_1$ to $0.3x\lambda_1$, and a current flows from the radiator to the first slot. When the current flows through the distance of $0.2x\lambda_1$ to $0.3x\lambda_1$, the current is relatively weak, an electric field is relatively strong, resonance is generated, and the current is confined in and around the first slot, so that resonance is generated at the first slot after a current of the electromagnetic wave signal of the first frequency band flows through the path, and the current is confined in and around the first slot.

The first slot is arc shaped, a distance between an inner side of the first slot and a center of the radiator is a first radius, and the first radius is $0.25x\lambda_1$. The first radius is $0.25x\lambda_1$, so that resonance can be generated at the first slot after the current of the electromagnetic wave signal of the first frequency band flows through the path. Because at $0.25x\lambda_1$, the current is the smallest, the electric field is the strongest, and a resonance effect is the best, the current is confined in and around the first slot.

A length of the first slot extending in a circumference direction is a first electrical length, and the first electrical length is $0.5x\lambda_1$. The first electrical length is set to $0.5x\lambda_1$, so that resonance is generated at the first slot when the current of the electromagnetic wave signal of the first frequency band flows to the first slot.

A length of the first slot in a radial direction is a first width, the first width is $0.05x\lambda_1$, and the first frequency band is 5.9 GHz. The first width is set to $0.05x\lambda_1$, to obtain the first frequency band 5.9 GHz meeting an operating frequency band range of the antenna.

In an embodiment, the signal source is further configured to feed an electromagnetic wave signal of a second frequency band into the radiator, the second frequency band is lower than the first frequency band, the antenna apparatus further includes a third slot and a fourth slot that are located on peripheries of the first slot and the second slot, both the third slot and the fourth slot are closed slots, and the third slot and the fourth slot are used to restrain current distribution on the ground plate, so that a current generated by the electromagnetic wave signal of the second frequency band is confined in and around the third slot and the fourth slot.

The signal source feeds the electromagnetic wave signal of the second frequency band, so that the antenna apparatus may be further configured to radiate the electromagnetic wave signal of the second frequency band, and the antenna apparatus may be used for a multi-frequency terminal. In addition, the current generated by the electromagnetic wave signal of the second frequency band is confined to the third slot and the fourth slot, so that a horizontal plane gain of the electromagnetic wave signal of the second frequency band can be improved.

The third slot and the fourth slot are symmetrically disposed by using the joint between the radiator and the ground plate as the center. The third slot and the fourth slot that are symmetrically centered may enable that current distribution almost the same is generated on the ground plate around the radiator, so that the shapes of the radiation patterns of the antenna in all the directions around the radiator are almost the same.

A radial distance from the radiator to the third slot ranges from $0.2x\lambda_2$ to $0.3x\lambda_2$, and $\lambda_2$ is a wavelength of the electromagnetic wave signal of the second frequency band. The distance between the third slot and the radiator is set to $0.2x\lambda_2$ to $0.3x\lambda_2$, and a current flows from the radiator to the third slot. When flowing through the distance of $0.2x\lambda_2$ to $0.3x\lambda_2$, the current is relatively weak, an electric field is relatively strong, resonance is generated, and the current is confined in and around the third slot, so that resonance is generated at the third slot after a current of the electromagnetic wave signal of the second frequency band flows through the path, and the current is confined in and around the third slot.

The third slot is arc shaped, a distance between an inner side of the third slot and the center of the radiator is a second radius, and the second radius is $0.25x\lambda_2$. The second radius is $0.25x\lambda_2$, so that resonance can be generated at the third slot after the current of the electromagnetic wave signal of the second frequency band flows through the path. Because at $0.25x\lambda_2$, the current is the smallest, the electric field is the strongest, and a resonance effect is the best, the current is confined in and around the third slot.

A length of the third slot extending in the circumference direction is a second electrical length, and the second electrical length is $0.5x\lambda_2$. The second electrical length is set to $0.5x\lambda_2$, so that resonance is generated at the third slot when the current of the electromagnetic wave signal of the second frequency band flows to the third slot.

A length of the third slot in the radial direction is a second width, the second width is equal to the first width, and the second frequency band is 2.45 GHz. The first width and the second width are set to be the same, to obtain the second frequency band 2.45 GHz meeting the operating frequency band range of the antenna.

According to a second aspect, an embodiment of this application provides an antenna apparatus, including a ground plate, a radiator, a signal source, a first filter, and a second filter, where the radiator is disposed on the ground plate, the signal source is configured to feed electromagnetic wave signals of a first frequency band and a second frequency band into the radiator, and the second frequency band is lower than the first frequency band, a third slot and a fourth slot are disposed on the ground plate, both the third slot and the fourth slot are closed slots and surround the radiator, the first filter is disposed in the third slot and divides the third slot into two slots, the second filter is disposed in the fourth slot and divides the fourth slot into two slots, and the first filter and the second filter enable the third slot and the fourth slot to each form two different electrical lengths, so that currents generated by the electromagnetic wave signals of the first frequency band and the second frequency band can be confined in and around the third slot and the fourth slot.

The third slot and the fourth slot surrounding the radiator are disposed to prevent the current from flowing to an edge of the ground plate. The first filter and the second filter are disposed, so that two different electrical lengths are generated in the third slot and two different electrical lengths are generated in the fourth slot. Therefore, the radiator generates resonance in two modalities the first frequency band and the second frequency band, to meet a multi-frequency communication requirement. In addition, because the current is confined to the third slot and the fourth slot, horizontal plane gains of the electromagnetic wave signals of the first frequency band and the second frequency band are increased.

Both the first filter and the second filter are band-pass filters in which an inductor and a capacitor are connected in series, and are configured to enable the current generated by the electromagnetic wave signal of the second frequency band to pass and block the current generated by the electromagnetic wave signal of the first frequency band, so that an electrical length of the electromagnetic wave signal of the second frequency band is greater than an electrical length of the electromagnetic wave signal of the first frequency band. The first filter and the second filter are disposed as the band-pass filters, so that two electrical lengths are generated in the third slot, two electrical lengths are generated in the fourth slot, the entire third slot is the electrical length of the second frequency band with a lower frequency, and a part of the third slot is the electrical length of the first frequency band with a higher frequency. The other part is not used to confine the electromagnetic wave signal of the first frequency band because no current flows through the other part due to a blocking effect of the first filter.

A specific location of the first filter disposed in the third slot and a specific location of the second filter disposed in the fourth slot are related to a wavelength $\lambda_1$ of the electromagnetic wave signal of the first frequency band. The first filter is disposed at $0.5x\lambda_1$ away from an endpoint of the third slot, and the second filter is disposed at $0.5x\lambda_1$ away from an endpoint of the fourth slot. Through the foregoing settings, $0.5x\lambda_1$ is a first electrical length of the electromagnetic wave signal of the first frequency band, and $0.5x\lambda_2$ is a second electrical length of the electromagnetic wave signal of the second frequency band, where $\lambda_1$ is the wavelength of the electromagnetic wave signal of the first frequency band, and $\lambda_2$ is a wavelength of the electromagnetic wave signal of the second frequency band.

The third slot and the fourth slot are symmetrically disposed by using a joint between the radiator and the ground plate as a center. The third slot and the fourth slot that are symmetrically centered may enable that current distribution almost the same is generated on the ground plate around the radiator, so that shapes of radiation patterns of an antenna in all directions around the radiator are almost the same.

A radial distance from the radiator to the third slot ranges from $0.2x\lambda_2$ to $0.3x\lambda_2$, and $\lambda_2$ is the wavelength of the electromagnetic wave signal of the second frequency band. The distance between the third slot and the radiator is set to $0.2x\lambda_2$ to $0.3x\lambda_2$, and a current flows from the radiator to the third slot. When flowing through the distance of $0.2x\lambda_2$ to $0.3x\lambda_2$, the current is relatively weak, an electric field is relatively strong, resonance is generated, and the current is confined in and around the third slot, so that resonance is generated at the third slot after the currents of the electromagnetic wave signals of the first frequency band and the second frequency band flow through the path, and the current is confined in and around the third slot.

The third slot is arc shaped, a distance between an inner side of the third slot and a center of the radiator is a first radius, and the first radius is $0.25x\lambda_2$. The first radius is $0.25x\lambda_2$, so that resonance can be generated at the third slot after the current of the electromagnetic wave signal of the first frequency band flows through the path. Because at $0.25x\lambda_2$, the current is the smallest, the electric field is the strongest, and a resonance effect is the best, the current is confined in and around the third slot.

A length of the third slot extending in a circumference direction is a first electrical length, and the first electrical length is $0.5x\lambda_2$. The first electrical length is set to $0.5x\lambda_2$, so that resonance is generated at the third slot when the current of the electromagnetic wave signal of the second frequency band flows to the third slot.

A length of the third slot in a radial direction is a first width, the first width is $0.05x\lambda_1$, $\lambda_1$ is the wavelength of the electromagnetic wave signal of the first frequency band, the first frequency band is 5.9 GHz, and the second frequency band is 2.45 GHz. The first width is set to $0.05x\lambda_1$, to obtain the first frequency band 5.9 GHz and the second frequency band 2.45 GHz meeting an operating frequency band range of the antenna.

According to a third aspect, an embodiment of this application provides a terminal, including a PCB board and the antenna apparatus, where the radiator of the antenna apparatus is disposed on the PCB board, the ground plate is a part of the PCB board, the signal source configured for feeding is disposed on the PCB board, and the signal source feeds power to the radiator.

BRIEF DESCRIPTION OF DRAWINGS

To describe the technical solutions in some of the embodiments of this application more clearly, the following briefly describes the accompanying drawings describing some of the embodiments. It is clear that the accompanying drawings in the following description show some embodiments of the present disclosure, and a person of ordinary skill in the art may still derive other drawings from these accompanying drawings without creative efforts.

FIG. 2*e*-1 is a top view of the simulation directivity diagram, FIG. 2*e*-2 is a side view of the simulation directivity diagram, and FIG. 2*e*-3 is a side view of the simulation directivity diagram (vertical to a view angle of FIG. 2*e*-2);

FIG. 2*f*-1 to FIG. 2*f*-3 are simulation directivity diagrams of an antenna apparatus with a slot according to an embodiment, where in the figures, FIG. 2*f*-1 is a top view of the simulation directivity diagram. FIG. 2*f*-2 is a side view of the simulation directivity diagram, and FIG. 2*f*-3 is a side view of the simulation directivity diagram (vertical to a view angle of FIG. 2*f*-2);

FIG. 3*f*-1 to FIG. 3*f*-3 are simulation directivity diagrams of an antenna apparatus without a slot in a 2.45 GHz modal according to another embodiment, where in the figures, FIG. 3*f*-1 is a top view of the simulation directivity diagram, FIG. 3*f*-2 is a side view of the simulation directivity diagram, and FIG. 3*f*-3 is a side view of the simulation directivity diagram (vertical to a view angle of FIG. 3*f*-2);

FIG. 3*g*-1 to FIG. 3*g*-3 are simulation directivity diagrams of an antenna apparatus without a slot in a 5.9 GHz modal according to another embodiment, where in the figures. FIG. 3*g*-1 is a top view of the simulation directivity diagram, FIG. 3*g*-2 is a side view of the simulation directivity diagram, and FIG. 3*g*-3 is a side view of the simulation directivity diagram (vertical to a view angle of FIG. 3*g*-2);

FIG. 3*h*-1 to FIG. 3*h*-3 are simulation directivity diagrams of an antenna apparatus with a slot in a 2.45 GHz modal according to another embodiment, where in the figures, FIG. 3*h*-1 is a top view of the simulation directivity diagram, FIG. 3*h*-2 is a side view of the simulation directivity diagram, and FIG. 3*h*-3 is a side view of the simulation directivity diagram (vertical to a view angle of FIG. 3*h*-2);

FIG. 3*i*-1 to FIG. 3*i*-3 are simulation directivity diagrams of an antenna apparatus with a slot in a 5.9 GHz modal according to another embodiment, where in the figures, FIG. 3*i*-1 is a top view of the simulation directivity diagram, FIG. 3*i*-2 is a side view of the simulation directivity diagram, and FIG. 3*i*-3 is a side view of the simulation directivity diagram (vertical to a view angle of FIG. 3*i*-2);

FIG. 4*f*-1 to FIG. 4*f*-3 are simulation directivity diagrams of an antenna apparatus without a slot in a 2.45 GHz modal according to another embodiment, where in the figures, FIG. 4*f*-1 is a top view of the simulation directivity diagram, FIG.

4*f*-2 is a side view of the simulation directivity diagram, and FIG. 4*f*-3 is a side view of the simulation directivity diagram (vertical to a view angle of FIG. 4*f*-2);

FIG. 4*g*-1 to FIG. 4*g*-3 are simulation directivity diagrams of an antenna apparatus without a slot in a 5.9 GHz modal according to another embodiment, where in the figures, FIG. 4*g*-1 is a top view of the simulation directivity diagram. FIG. 4*g*-2 is a side view of the simulation directivity diagram, and FIG. 4*g*-3 is a side view of the simulation directivity diagram (vertical to a view angle of FIG. 4*g*-2);

FIG. 4*h*-1 to FIG. 4*h*-3 are simulation directivity diagrams of an antenna apparatus added with a filter with a slot in a 2.45 GHz modal according to another embodiment, where in the figures, FIG. 4*h*-1 is a top view of the simulation directivity diagram. FIG. 4*h*-2 is a side view of the simulation directivity diagram, and FIG. 4*h*-3 is a side view of the simulation directivity diagram (vertical to a view angle of FIG. 4*h*-2);

FIG. 4*i*-1 to FIG. 4*i*-3 are simulation directivity diagrams of an antenna apparatus added with a filter with a slot in a 5.9 GHz modal according to another embodiment, where in the figures, FIG. 4*i*-1 is a top view of the simulation directivity diagram, FIG. 4*i*-2 is a side view of the simulation directivity diagram, and FIG. 4*i*-3 is a side view of the simulation directivity diagram (vertical to a view angle of FIG. 4*i*-2)

DESCRIPTION OF EMBODIMENTS

Figure 1A:
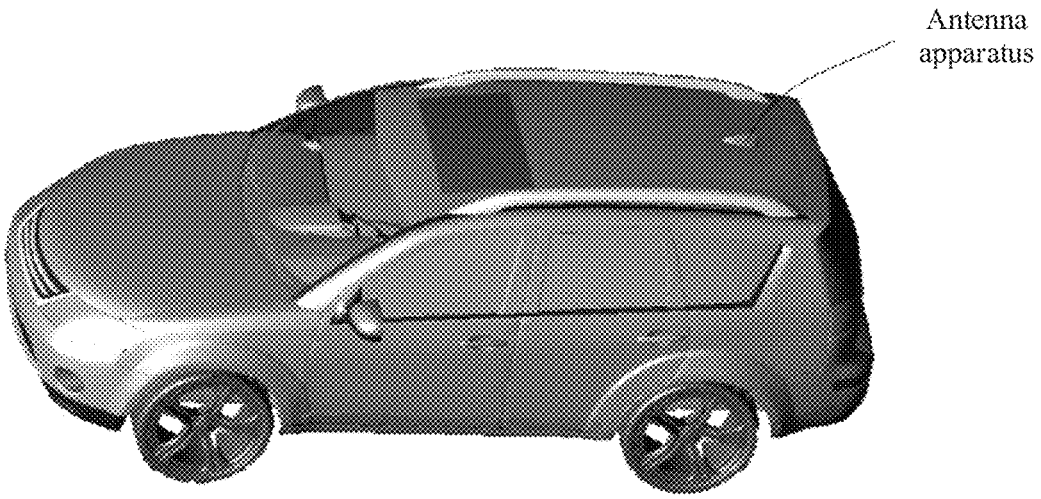
FIG. 1*a* is a schematic structural diagram of a terminal according to an embodiment.

Referring to FIG. 1*a*, an embodiment of this application provides a terminal. The terminal may be a mobile transportation vehicle such as a car or an airplane. A horizontal plane gain of an antenna apparatus of the terminal is improved, so that a wireless communication effect of the terminal is better. For example, the terminal is a car. The antenna apparatus of the terminal may be a vehicle-mounted external antenna or a vehicle-mounted T-Box, and the antenna apparatus of the terminal may be disposed at a location such as the top of the car or an engine cover.

Figure 1B:
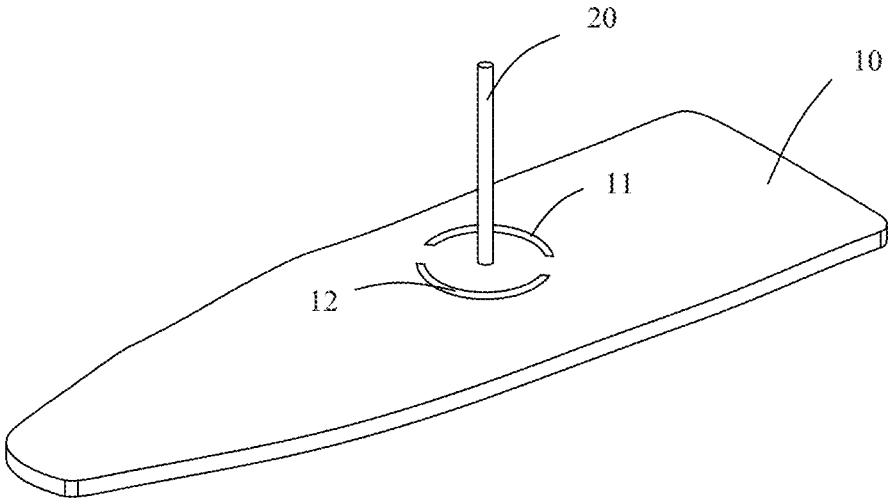
FIG. 1*b* is a schematic structural diagram of an antenna apparatus of the terminal in FIG. 1*a;*

Referring to FIG. 1*b*, a housing is omitted in the figure. The terminal includes a PCB board and the antenna apparatus provided in this embodiment of this application. A radiator 20 of the antenna apparatus is connected to the PCB board, the ground plate 10 is a part of the PCB board, a signal source configured for feeding is disposed on the PCB board, and the signal source feeds power to the radiator 20.

Because the PCB board 10 on the terminal cannot be infinitely large, a radiation pattern of the radiator 20 on the PCB board 10 is tilted, causing a decrease in a horizontal plane gain. However, the radiation pattern of the radiator 20 may be pulled down by disposing a slot on the PCB board 10. In this way, a maximum radiation direction of the radiator 20 is close to a horizontal plane. This increases a horizontal plane gain of an antenna and improves a wireless communication effect of the terminal.

Figure 2A:
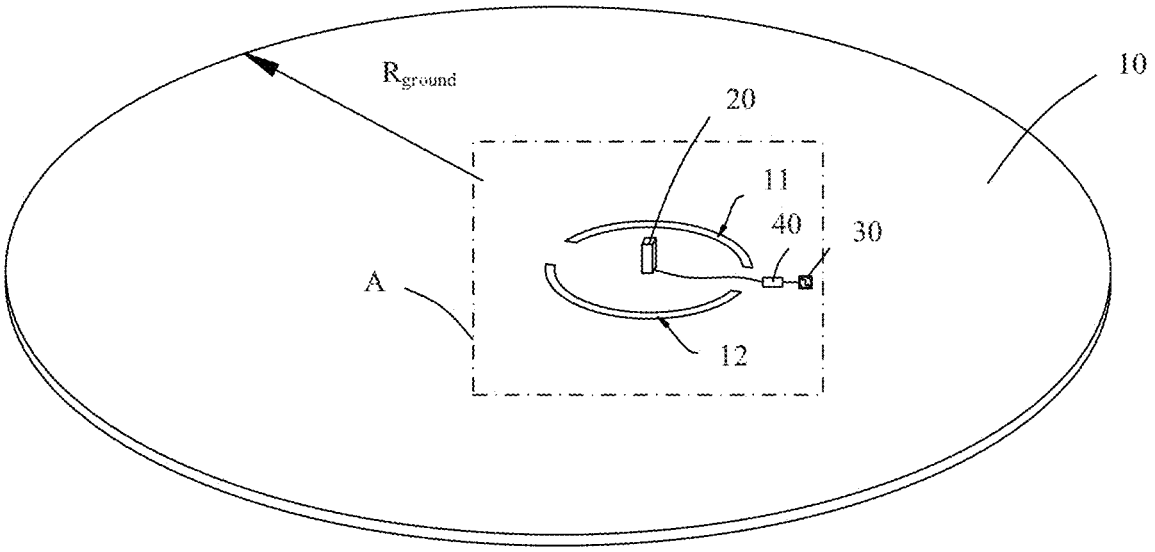
FIG. 2*a* is a schematic structural diagram of an antenna apparatus according to an embodiment.
Figure 2B:
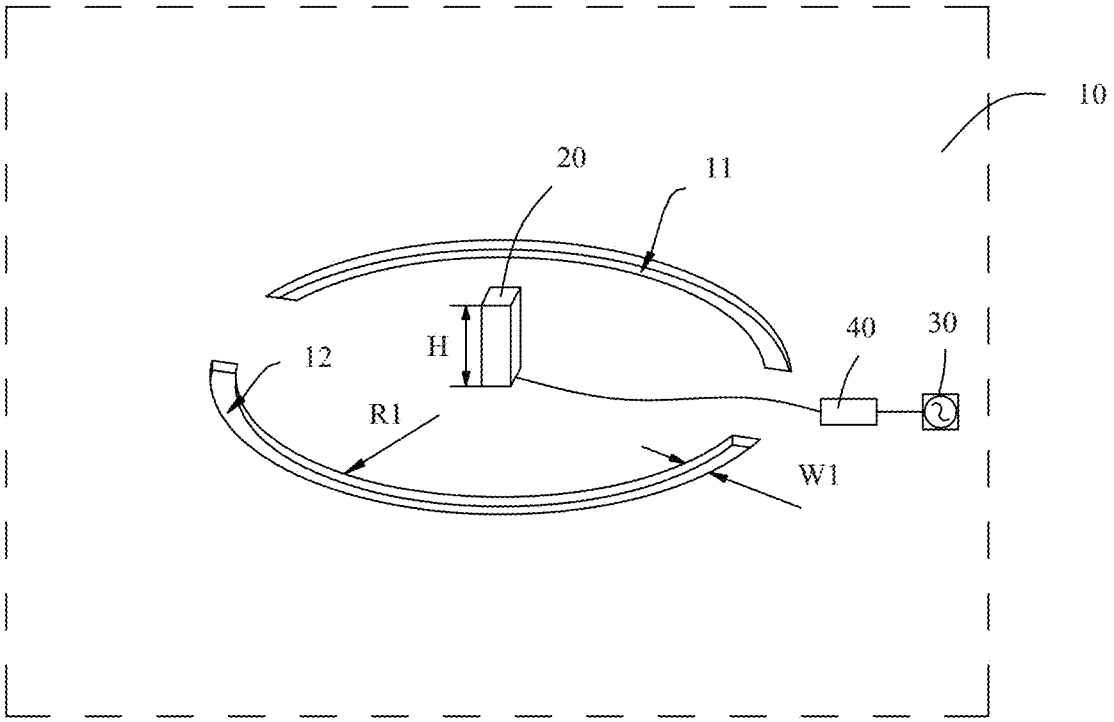
FIG. 2*b* is a schematic diagram of a partially enlarged structure at A in FIG. 2*a;*

Referring to FIG. 2*a* and FIG. 2*b*, an embodiment of this application provides an antenna apparatus, including a ground plate 10, a radiator 20, and a signal source 30. The radiator 20 is disposed on the ground plate 10, and the signal source 30 is configured to feed an electromagnetic wave signal of a first frequency band into the radiator 20. The antenna apparatus may further include a matching circuit 40, where the matching circuit 40 is electrically connected between the radiator 20 and the signal source 30, and is configured to adjust a resonance state of the radiator 20. A first slot 11 and a second slot 12 are disposed on the ground plate 10, both the first slot 11 and the second slot 12 are closed slots and surround the radiator 20, and the first slot 11 and the second slot 12 are configured to restrain current distribution on the ground plate 10, so that a current generated by the electromagnetic wave signal of the first frequency band is confined in and around the first slot 11 and the second slot 12.

The first slot 11 and the second slot 12 surrounding the radiator 20 are disposed to prevent a current from flowing to an edge of the ground plate 10, and the current is confined in and around the first slot 11 and the second slot 12, to change a radiation pattern of the radiator 20, so that a maximum radiation direction of the radiator 20 moves towards a horizontal plane. This improves a horizontal plane gain of the radiator 20.

Figure 2C:
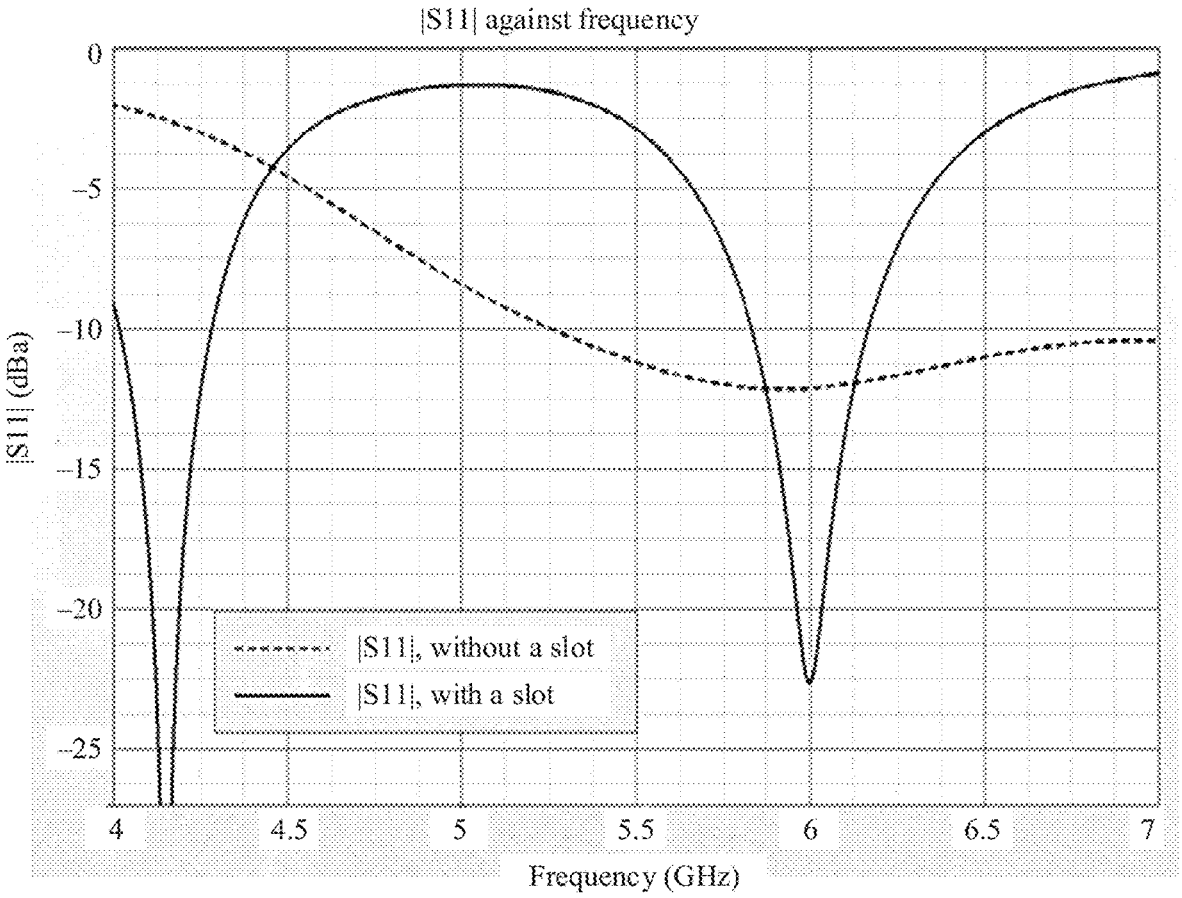
FIG. 2*c* is a schematic simulation diagram of a return loss (S 11) of an antenna apparatus according to an embodiment.
Figure 2D:
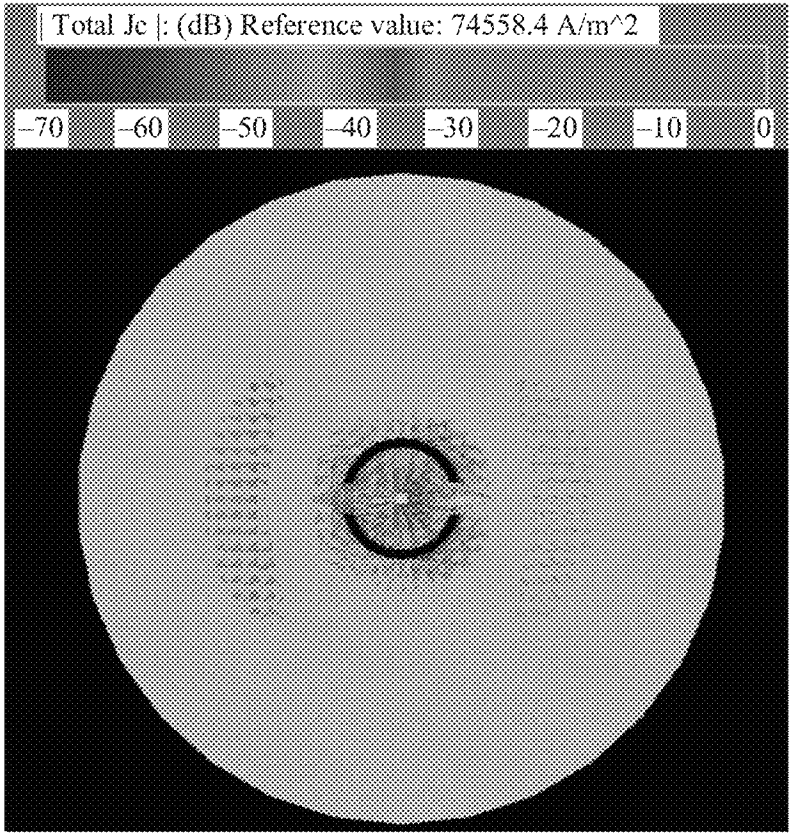
FIG. 2*d* is a schematic simulation diagram of current distribution on a ground plate before and after there is a slot according to an embodiment, where in the figure, a left diagram shows a simulation result of the current distribution on the ground plate without a slot, and a right diagram shows a simulation result of the current distribution on the ground plate with a slot.
Figure 2D:
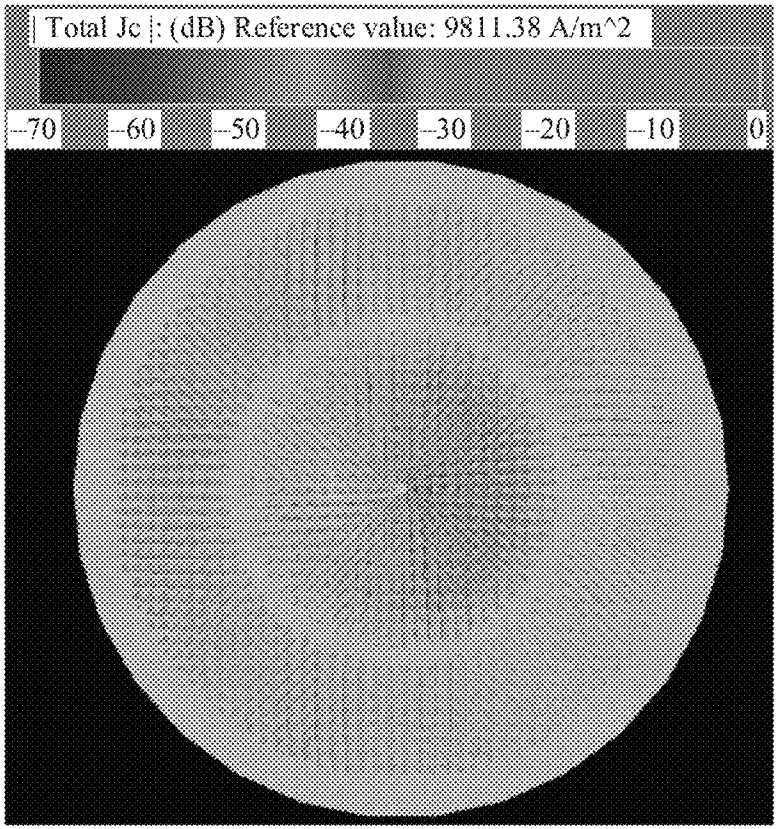
Figures 1, 2E:
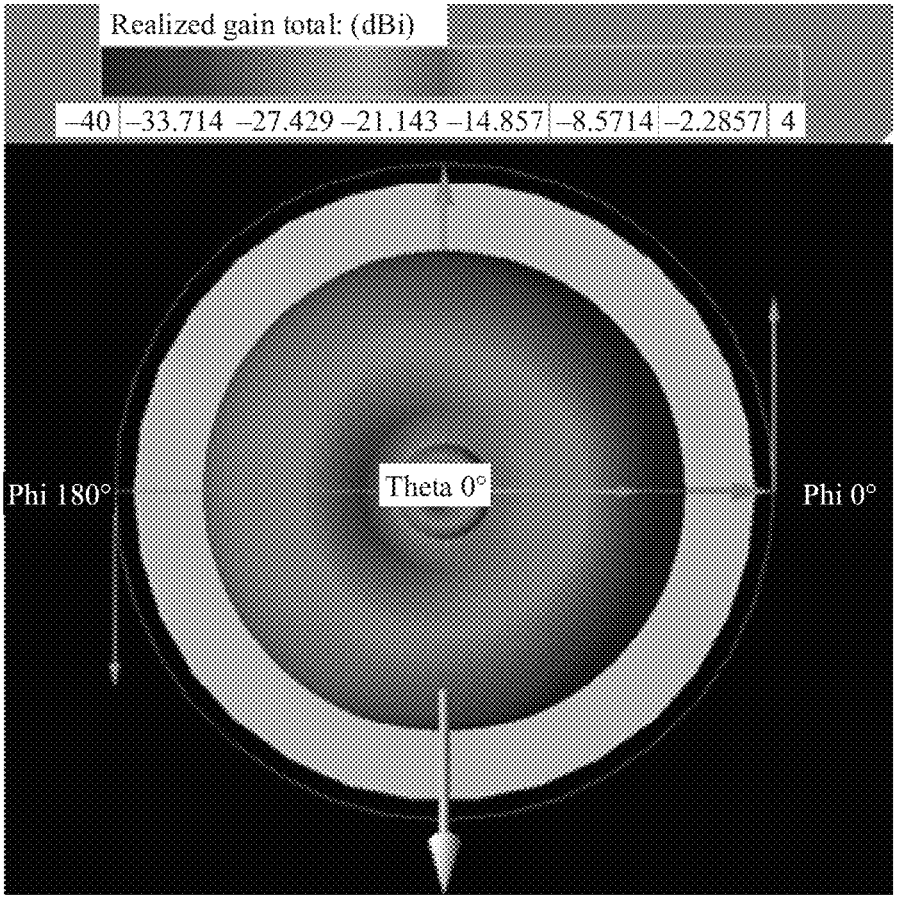
FIG. 2*e*-1 to FIG. 2*e*-3 are simulation directivity diagrams of an antenna apparatus without a slot according to an embodiment, where in the figures.

Similar to the terminal shown in FIG. 1, the ground plate 10 may be a PCB board, a copper-clad surface is disposed on the PCB board, and the radiator 20 is connected to the copper-clad surface to implement grounding. A size of the ground plate 10 may be set to be much greater than a size of the radiator 20, so that the ground plate 10 simulates an infinite ground as much as possible. This facilitates antenna design by referring to an antenna radiation theory of the infinite ground, and a difference between the ground plate 10 and the infinite ground is relatively small. The ground plate 10 may be in any shape such as a circle, a square, or a triangle, provided that a conductive surface that is approximately a plane can be provided as a horizontal plane of the ground plate 10.

Both the first slot 11 and the second slot 12 disposed on the ground plate 10 are closed slots. To be specific, the first slot 11 and the second slot 12 do not intersect, and are not connected to the edge of the ground plate 10, but are located in a middle part of the ground plate 10. Preferably, both the first slot 11 and the second slot 12 are disposed around a center point of the ground plate 10.

Specifically, a form in which the first slot 11 and the second slot 12 are disposed around the radiator 20 on the ground plate 10 may be that the first slot 11 is disposed around one side of the radiator 20, the second slot 12 is disposed around another side of the radiator 20 opposite to the first slot 11, and an angle formed by connection lines connecting the radiator 20 and two ends of each of the first slot 11 and the second slot 12 is less than 180°. In another disposing form, the first slot 11 and the second slot 12 are nested structures, the first slot 11 is located on an inner side of the second slot 12, that is, an included angle between connection lines connecting the radiator 20 and the two ends of the first slot 11 is greater than 180°, the second slot 12 is located on a side towards which an opening of the first slot 11 faces and does not overlap the first slot 11, and at least a part of the second slot 12 and at least a part of the first slot 11 at least partially encircle the radiator 20. Regardless of a disposing form, the ground plate 10 is enabled to have at least a partially connected area within and outside a slot area, to provide a support structure for the radiator 20. In addition, a current on the radiator 20 can flow from an inner part the slot area to an inner area of the first slot 11 and the second slot 12 and a surrounding area outside the slot area.

The first slot 11 and the second slot 12 may be in an arc shape, a wave shape, a rectangle (that is, the first slot 11 and the second slot 12 each have a straight line segment and a corner, so that the two are combined to form the rectangle), a sawtooth shape, or the like. It should be understood that, the first slot 11 and the second slot 12 need to be disposed around the radiator 20, and therefore the shapes of the first slot 11 and the second slot 12 cannot be two straight lines. The first slot 11 and the second slot 12 may be disposed by using a machining technology. Through grooves penetrating through an upper surface and a lower surface of the ground plate 10 are dug in the ground plate 10, to form the first slot 11 and the second slot 12.

The radiator 20 may be an antenna structure such as a monopole antenna, an inverted F antenna (IFA), or a loop antenna. The radiator 20 may be vertical to the ground plate 10. In other words, a main body of the radiator 20 is a standing structure, and is not attached to a surface of the ground plate 10, and an extension direction of the main body of the radiator 20 may be perpendicular to a plane (that is, a ground or a horizontal plane) on which the ground plate 10 is located, or may have a relatively small tilt angle. For example, an included angle between the extension direction of the radiator 20 and the plane on which the ground plate 10 is located ranges from 45° to 90°. In this way, an area occupied by a connection point between the radiator 20 and the ground plate 10 is the smallest, and the radiator 20 extends in a direction away from the ground plate 10, to simulate a radiation characteristic of the antenna in an ideal state (that is, on the infinite ground) as much as possible to obtain an approximate antenna radiation pattern.

The first slot 11 and the second slot 12 are symmetrically disposed by using a joint between the radiator 20 and the ground plate 10 as a center. The first slot 11 and the second slot 12 that are centrally symmetric may enable current distribution on the ground plate 10 around the radiator 20 to be almost the same, so that shapes of radiation patterns of the antenna in all directions around the radiator 20 are almost the same.

A radial distance from the radiator 20 to the first slot 11 ranges from $0.2x\lambda_1$ to $0.3x\lambda_1$, and $\lambda_1$ is a wavelength of the electromagnetic wave signal of the first frequency band. The distance between the first slot 11 and the radiator 20 is set to $0.2x\lambda_1$ to $0.3x\lambda_1$, and a current flows from the radiator 20 to the first slot 11. When the current flows through the distance of $0.2x\lambda_1$ to $0.3x\lambda_1$, the current is relatively weak, an electric field is relatively strong, resonance is generated, and the current is confined in and around the first slot 11, so that resonance is generated at the first slot 11 after the current of the electromagnetic wave signal of the first frequency band flows through the path, and the current is confined in and around the first slot 11.

The first slot 11 is arc shaped, a distance between an inner side of the first slot 11 and a center of the radiator 20 is a first radius R1, and the first radius R1 is $0.25x\lambda_1$. The first radius R1 is $0.25x\lambda_1$, so that resonance can be generated at the first slot 11 after the current of the electromagnetic wave signal of the first frequency band flows through the path. Because at $0.25x\lambda_1$, the current is the smallest, the electric field is the strongest, and a resonance effect is the best, the current is confined in and around the first slot 11.

A length of the first slot 11 extending in a circumference direction is a first electrical length, and the first electrical length is $0.5x\lambda_1$. The first electrical length is set to $0.5x\lambda_1$, so that resonance is generated at the first slot 11 when the current of the electromagnetic wave signal of the first frequency band flows to the first slot 11. A length of the first slot 11 in a radial direction is a first width W1, the first width W1 is $0.05x\lambda_1$, and the first frequency band is 5.9 GHz. The first width W1 is set to $0.05x\lambda_1$, to obtain the first frequency band 5.9 GHz meeting an operating frequency band range of the antenna.

In the field of antenna communications, there are frequency bands preferred in various application scenarios. Some of these frequency bands are included in standards and are mandatory for use, and relevant qualifications and applications are required to obtain the right to use the relevant frequency bands. Some of these frequency bands are industry practices. For example, frequency bands used by a smartphone are a low frequency, an intermediate frequency, and a high frequency, and there is an upper limit and a lower limit of each frequency band. An antenna of the smartphone needs to work in these frequency bands. Likewise, a vehicle-mounted antenna also has a dedicated operating frequency band. In conclusion, when the structure of the antenna apparatus is designed, it needs to be ensured that the antenna works within a specified frequency band range. In this embodiment, the first frequency band is within the specified frequency band range. For example, in the field of terminals such as a vehicle-mounted antenna, the frequency 5.9 GHz is a common communication frequency, and the frequency 5.9 GHz obtained through the foregoing settings is within a preferred frequency band range of the vehicle-mounted antenna, so that a relatively good wireless communication effect can be implemented. Structures of the first slot 11 and the second slot 12 need to be disposed to obtain the first frequency band. More specifically, sizes of the first slot 11 and the second slot 12 need to be limited, and the sizes are related to the wavelength $\lambda_1$ of the electromagnetic wave signal that is of the first frequency band and that is fed into the radiator 20. Therefore, when resonance of the first frequency band is achieved, different sizes of the first slot 11 and the second slot 12 may be obtained based on different $\lambda_1$, to meet arrangement requirements of antenna apparatuses of various terminals.

In this embodiment, the radiator 20 preferably uses a monopole antenna, and a height of the radiator 20 is preferably $0.25x\lambda_1$. The monopole antenna has a dual feature. In an ideal state (that is, the ground plane is an infinite plane), a maximum radiation direction of the monopole antenna is a horizontal plane. However, when the monopole antenna is applied to a terminal, a size of the ground plane 10 cannot be infinite. Therefore, the first slot 11 and the second slot 12 are disposed to change a directivity pattern of the antenna. Specifically, a height of radiator 20 is $0.25x\lambda_1$, the first radius R1 ranges from $0.2x\lambda_1$ to $0.3x\lambda_1$, and is preferably $0.25x\lambda_1$. In this way, a total length of a path through which the current flows on the radiator 20 and the ground plate 10 is $0.5x\lambda_1$. In this case, the radiation pattern of the antenna is the closest to a radiation form of a dipole antenna, and a horizontal plane gain obtained is the highest. In addition, the first electrical length of the first slot 11 is set to $0.5x\lambda_1$, and the signal source 30 feeds power to the radiator 20 and feeds power to the first slot 11, so that a resonance modal excited in the first slot 11 is the same as that of the radiator 20. When the current on the ground plate 10 flows to the first slot 11, the resonance is generated at the first slot 11, and the current no longer flows further. Compared with a structure in which no slot is disposed on the ground plate 10, the structure in this embodiment changes current distribution on the ground plate 10, so that the maximum radiation direction of the antenna moves towards the horizontal plane. This improves the horizontal plane gain.

With reference to FIG. 2*a* and FIG. 2*b*, a specific embodiment is provided. The ground plate 10 is a circle, a radius $R_{ground}$ of the ground plate 10 is 65 mm, the radiator 20 is a monopole antenna, a height H of the radiator 20 is 10 mm, a first radius R1 is 10 mm, a first electrical length is 20 mm, and a first width W1 is 2 mm. The antenna apparatus is simulated, and for a simulation result, refer to subsequent descriptions.

Referring to FIG. 2*c*, a diagram of an antenna return loss S11 shows that when there is no slot, no clear resonance point is included in an antenna return loss curve (shown by a dashed line), but in an antenna return loss curve (shown by a solid line) after the first slot 11 and the second slot 12 are disposed, it can be clearly seen that a resonance frequency is near a 6 GHz location, and the resonance is the first frequency band needed to be obtained in this embodiment. An emulation result is basically the same as an expected resonance point 5.9 GHz. In this way, the antenna apparatus is designed.

Referring to FIG. 2*d*, in the figure, a left figure is a current distribution diagram when there is no slot, and a right figure is a current distribution diagram after a slot is disposed. When there is no slot, current distribution on the ground plate 10 extends to an edge of the plate. After the slot is added, most current on the ground plate is "confined" in and around the slot, a current outside the slot is relatively weak, and the slot changes the current distribution on the ground plate 10. This changes a directivity pattern and a horizontal plane gain of an antenna.

Figures 2, 2E:
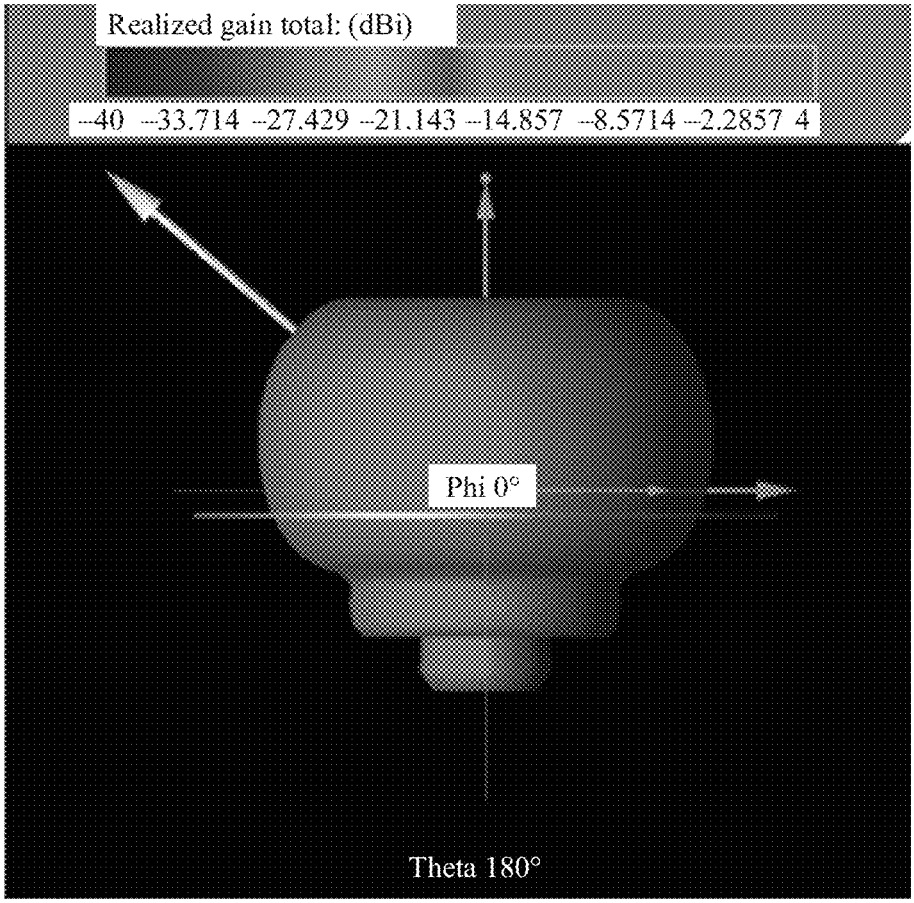
Figures 2, 2E, 3:
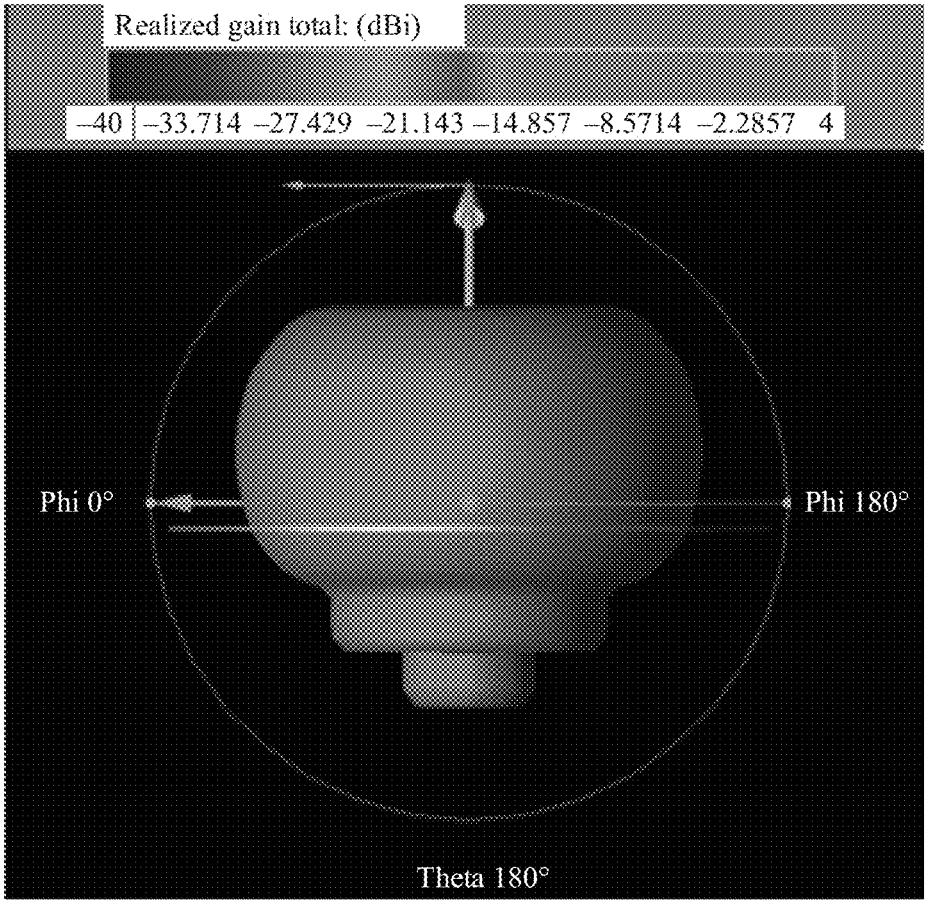

Referring to FIG. 2*e*-1 to FIG. 2*e*-3, in the figures, FIG. 2*e*-1 is a top view of a simulation directivity diagram, FIG. 2*e*-2 is a side view of the simulation directivity diagram, and FIG. 2*e*-3 is a side view of the simulation directivity diagram (vertical to a view angle of FIG. 2*e*-2). When there is no slot, a maximum radiation direction of an antenna is tilted. Therefore, the maximum radiation direction deviates from a horizontal plane relatively far and a horizontal plane gain decreases.

Figures 1, 2F:
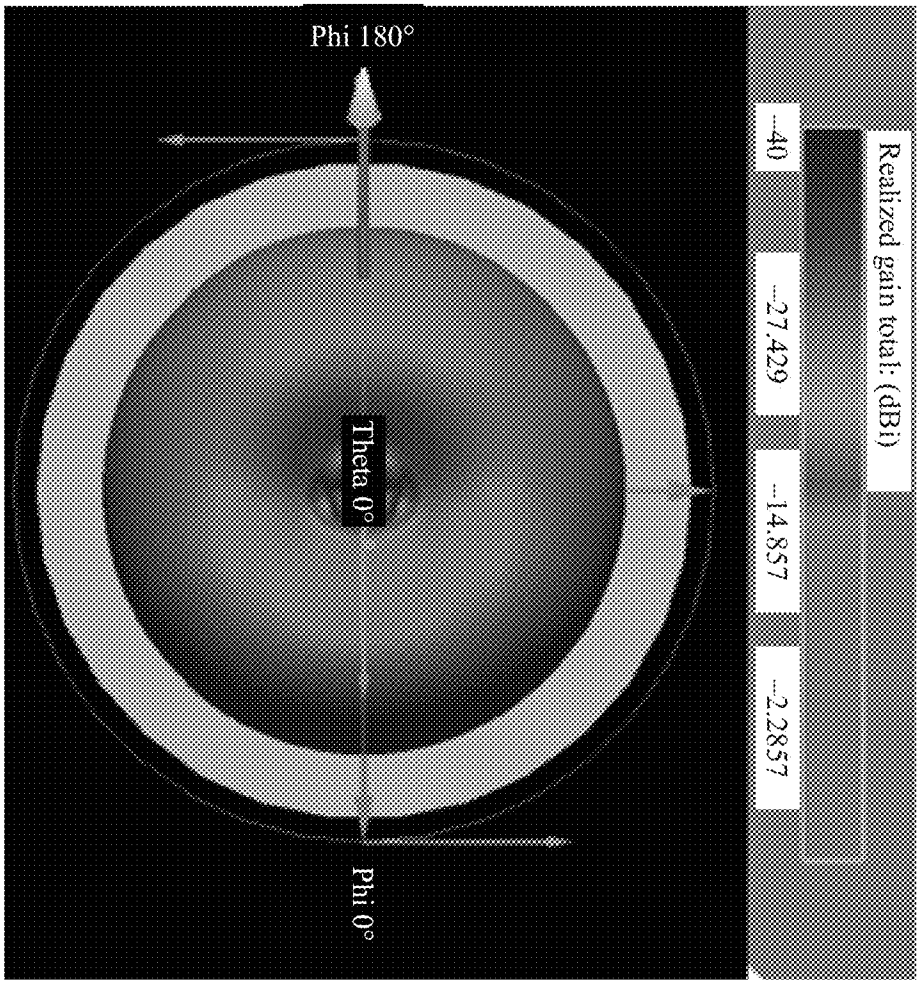
Figures 2, 2F:
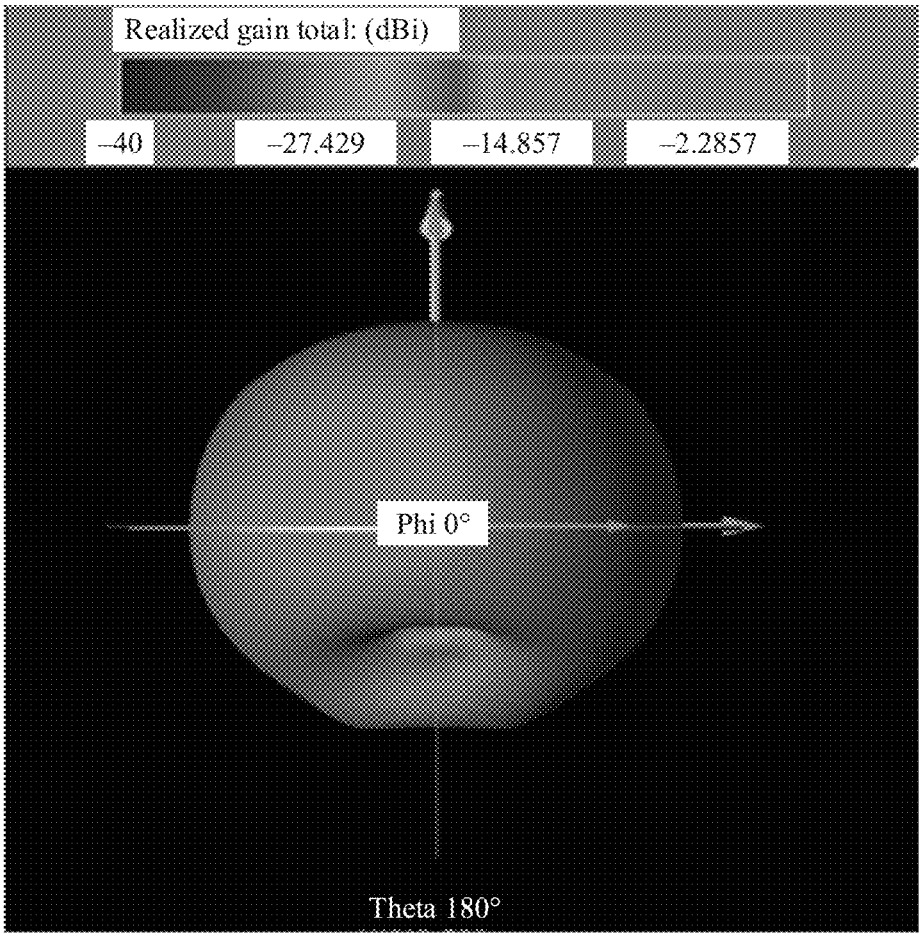
Figures 2, 2F, 3:
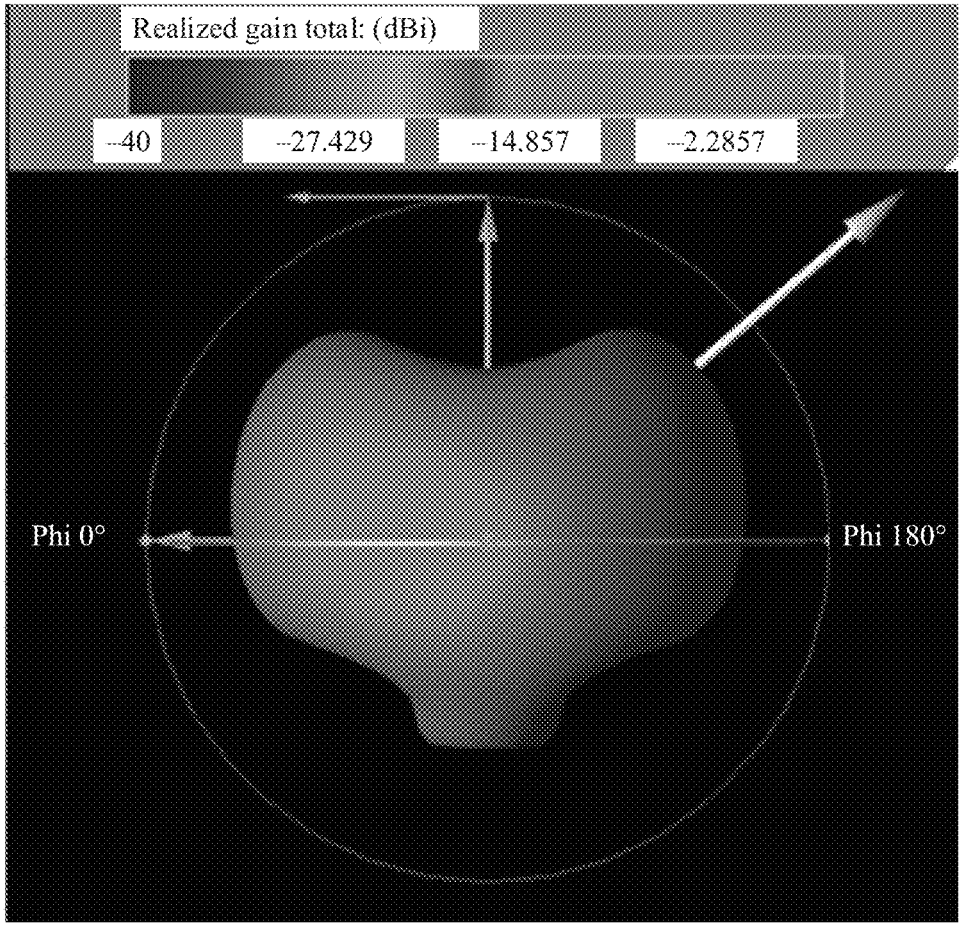

Referring to FIG. 2*f*-1 to FIG. 2*f*-3, in the figures, FIG. 2*f*-1 is a top view of a simulation directivity diagram. FIG. 2*f*-2 is a side view of the simulation directivity diagram, and FIG. 2*f*-3 is a side view of the simulation directivity diagram (vertical to a view angle of FIG. 2*f*-2). After a slot is disposed, a change of current distribution on the ground plate 10 brings a change of a radiation pattern of an antenna, and the radiation pattern of the antenna is pulled down, so that a degree of deviation of a maximum radiation direction of the antenna from a horizontal plane is reduced, and the maximum radiation direction of the antenna is closer to the horizontal plane. This increases a horizontal plane gain.

Figure 2G:
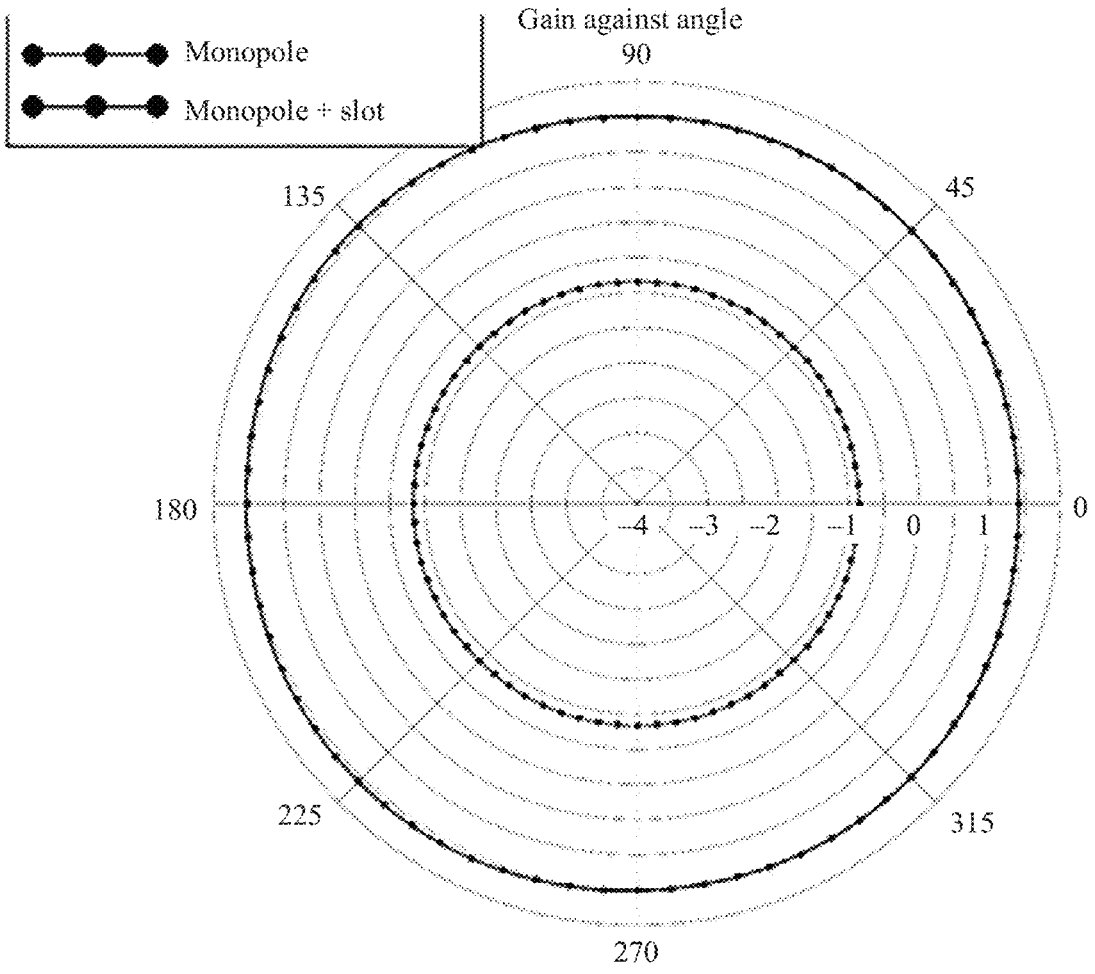
FIG. 2*g* is a schematic comparison diagram of a horizontal plane gain of an antenna apparatus before and after there is a slot according to an embodiment.

Referring to FIG. 2*g*, a connection line of dots of an inner circle in the figure is a horizontal plane gain when there is no slot, and a connection line of dots of an outer circle in the figure is a horizontal plane gain after a slot is disposed. It can be seen that the horizontal plane gain is increased by more than 2 dB after the slot is disposed.

Figure 3A:
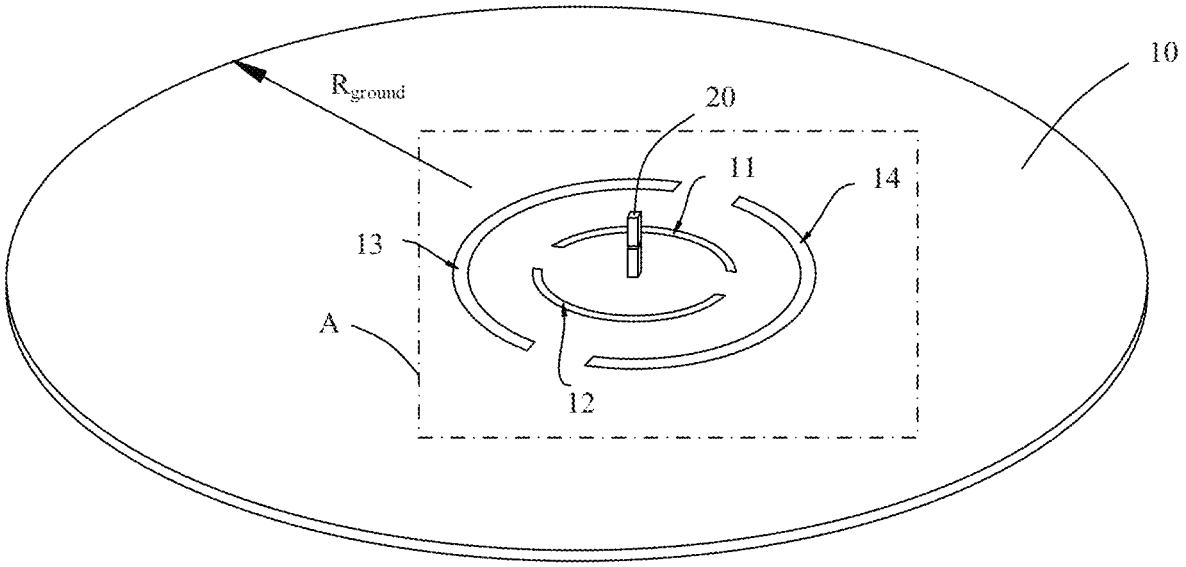
FIG. 3*a* is a schematic structural diagram of an antenna apparatus according to another embodiment, where a signal source and a matching circuit are omitted in the figure.
Figure 3B:
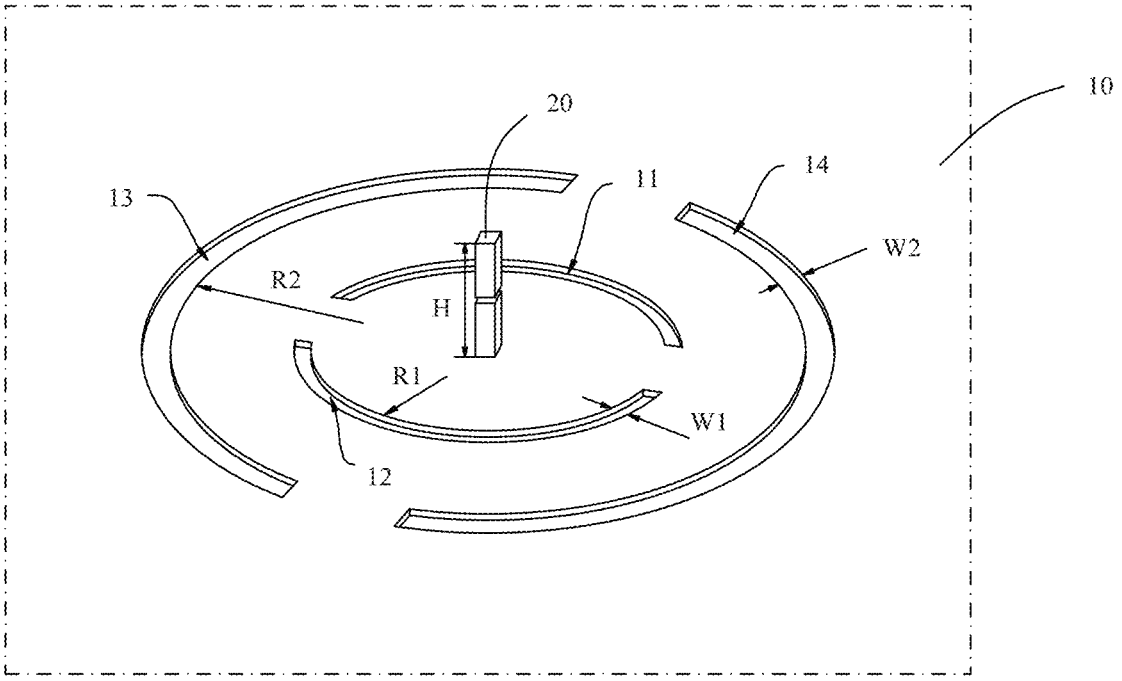
FIG. 3*b* is a schematic diagram of a partially enlarged structure at A in FIG. 3*a;*

In an embodiment, referring to FIG. 3*a* and FIG. 3*b*, a signal source 30 and a matching circuit 40 are omitted in the figure. Similar to the foregoing embodiment, a difference lies in that the signal source 30 is further configured to feed an electromagnetic wave signal of a second frequency band into the radiator 20, where the second frequency band is lower than the first frequency band, the antenna apparatus further includes a third slot 13 and a fourth slot 14 that are located on peripheries of the first slot 11 and the second slot 12, both the third slot 13 and the fourth slot 14 are closed slots, and the third slot 13 and the fourth slot 14 are used to restrain current distribution on the ground plate 10, so that a current generated by the electromagnetic wave signal of the second frequency band is confined in and around the third slot 13 and the fourth slot 14.

The signal source 30 feeds the electromagnetic wave signal of the second frequency band, so that the antenna apparatus may be further configured to radiate the electromagnetic wave signal of the second frequency band, and the antenna apparatus may be used for a multi-frequency terminal. In addition, the current generated by the electromagnetic wave signal of the second frequency band is confined to the third slot 13 and the fourth slot 14, so that a horizontal plane gain of the electromagnetic wave signal of the second frequency band can be improved.

In this embodiment, both the first frequency band and the second frequency band are within specified frequency band ranges, and the specified frequency bands are two frequency ranges with different ranges, and the two frequency ranges do not overlap.

The third slot 13 and the fourth slot 14 are symmetrically disposed by using a joint between the radiator 20 and the ground plate 10 as a center. The third slot 13 and the fourth slot 14 that are symmetrically centered may enable that current distribution almost the same is generated on the ground plate 10 around the radiator 20, so that shapes of radiation patterns of an antenna in all directions around the radiator 20 are almost the same.

A radial distance from the radiator 20 to the third slot 13 ranges from $0.2x\lambda_2$ to $0.3x\lambda_2$, and $\lambda_2$ is a wavelength of the electromagnetic wave signal of the second frequency band. The distance between the third slot 13 and the radiator 20 is set to $0.2x\lambda_2$ to $0.3x\lambda_2$, and a current flows from the radiator 20 to the third slot 13. When flowing through the distance of $0.2x\lambda_2$ to $0.3x\lambda_2$, the current is relatively weak, an electric field is relatively strong, resonance is generated, and the current is confined in and around the third slot 13, so that resonance is generated at the third slot 13 after the current of the electromagnetic wave signal of the second frequency band flows through the path, and the current is confined in and around the third slot 13.

The third slot 13 is arc shaped, a distance between an inner side of the third slot 13 and a center of the radiator 20 is a second radius R2, and the second radius R2 is $0.25x\lambda_2$. The second radius R2 is $0.25x\lambda_2$, so that resonance can be generated at the third slot 13 after the current of the electromagnetic wave signal of the second frequency band flows through the path. Because at $0.25x\lambda_2$, the current is the smallest, the electric field is the strongest, and a resonance effect is the best, the current is confined in and around the third slot 13.

A length of the third slot 13 extending in the circumference direction is a second electrical length, and the second electrical length is $0.5x\lambda_2$. The second electrical length is set to $0.5x\lambda_2$, so that resonance is generated at the third slot 13 when the current of the electromagnetic wave signal of the second frequency band flows to the third slot 13.

A length of the third slot 13 in the radial direction is a second width W2, the second width W2 is equal to the first width W1, and the second frequency band is 2.45 GHz. The first width W1 and the second width W2 are set to be the same, to obtain the second frequency band 2.45 GHz meeting the operating frequency band range of the antenna. In the field of terminals such as a vehicle-mounted antenna, the frequency 2.45 GHz is a common communication frequency, and the frequency 2.45 GHz obtained through the foregoing settings is within a preferred frequency band range of the vehicle-mounted antenna, so that a relatively good wireless communication effect can be implemented.

In this embodiment, the radiator 20 preferably uses a monopole antenna, and a height of the radiator 20 is preferably $0.25x\lambda_2$. Sizes of the first slot 11, the second slot 12, the third slot 13, and the fourth slot 14 are limited, and the sizes are set to be related to the wavelength $\lambda_1$ of the electromagnetic wave signal of the first frequency band and the wavelength $\lambda_2$ of the electromagnetic wave signal of the second frequency band that are fed into the radiator 20. Therefore, the first slot 11 and the second slot 12 are used to generate resonance of the electromagnetic wave signal of the first frequency band, and the third slot 13 and the fourth slot 14 are used to generate resonance of the electromagnetic wave signal of the second frequency band. Different sizes of the radiator 20, the first slot 11, the second slot 12, the third slot 13, and the fourth slot 14 may be obtained based on different $\lambda$ to meet arrangement requirements of antenna apparatuses of various terminals.

With reference to FIG. 3*a* and FIG. 3*b*, a specific embodiment is provided. The ground plate 10 is a circle, a radius $R_{ground}$ of the ground plate 10 is 100 mm, the radiator 20 is a monopole antenna, a height H of the radiator 20 is 20 mm, a first radius R1 is 8 mm, and a first electrical length is 20 mm, a first width W1 and a second width W2 are 2 mm, a second radius R2 is 20 mm, and a second electrical length is 40 mm. The antenna apparatus is simulated, and for a simulation result, refer to subsequent descriptions.

Figure 3C:
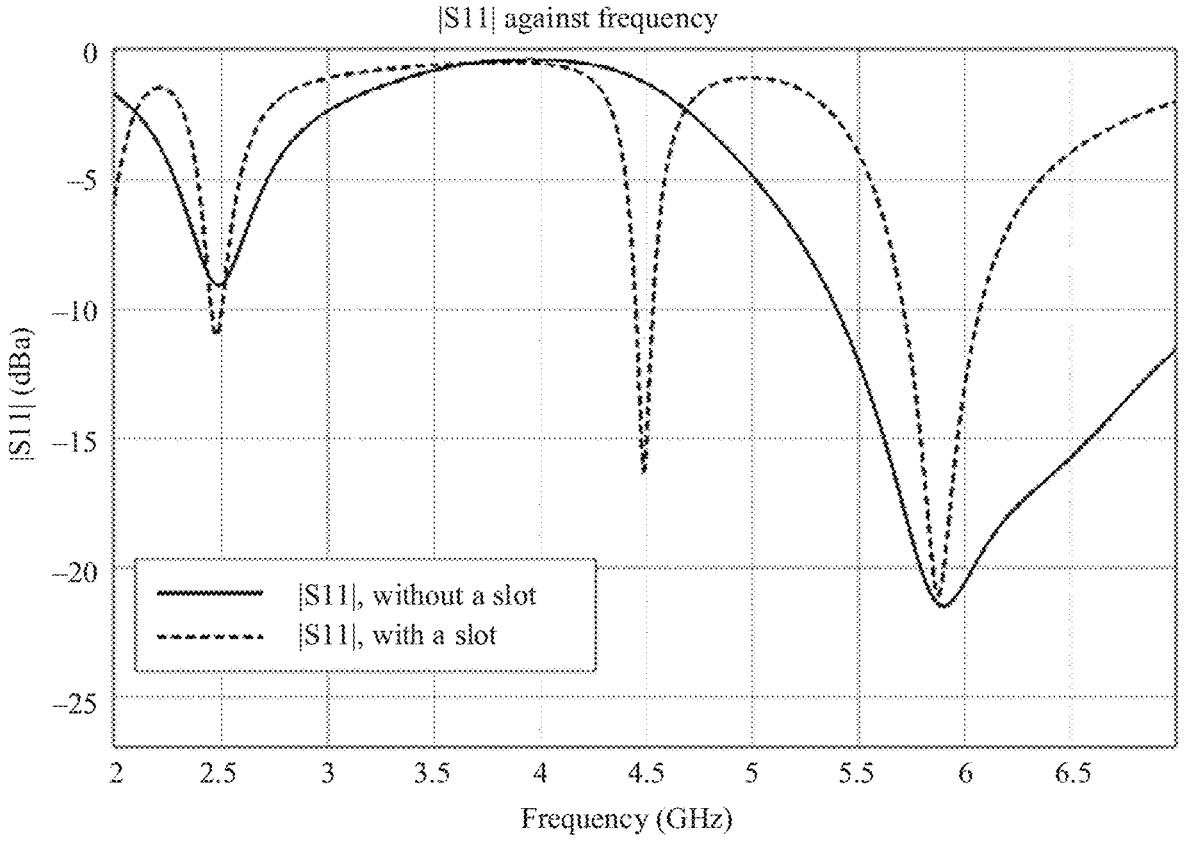
FIG. 3*c* is a schematic simulation diagram of a return loss (S11) of an antenna apparatus according to another embodiment.

Referring to FIG. 3*c*, a diagram of an antenna return loss S11 shows resonance points in an antenna return loss curve (shown by a solid line) when there is no slot, however, in an antenna return loss curve (shown by a dashed line) after the first slot 11, the second slot 12, the third slot 13, and the fourth slot 14 are disposed, it can be clearly seen that two resonance points are generated near locations of 2.5 GHz and 5.9 GHz. The resonance point near 2.5 GHz is the first frequency band expected to be obtained in this embodiment, and the resonance point near 5.9 GHz is the second frequency band expected to be obtained in this embodiment. An emulation result is basically the same as preset resonance points of 2.45 GHz and 5.9 GHz. In this way, the antenna apparatus is designed. It should be noted that resonance near a 4.5 GHz location is further generated, the resonance is generated by resonance of the first slot 11 and the second slot 12, and is different from a purpose of this embodiment and may be ignored.

Figure 3D:
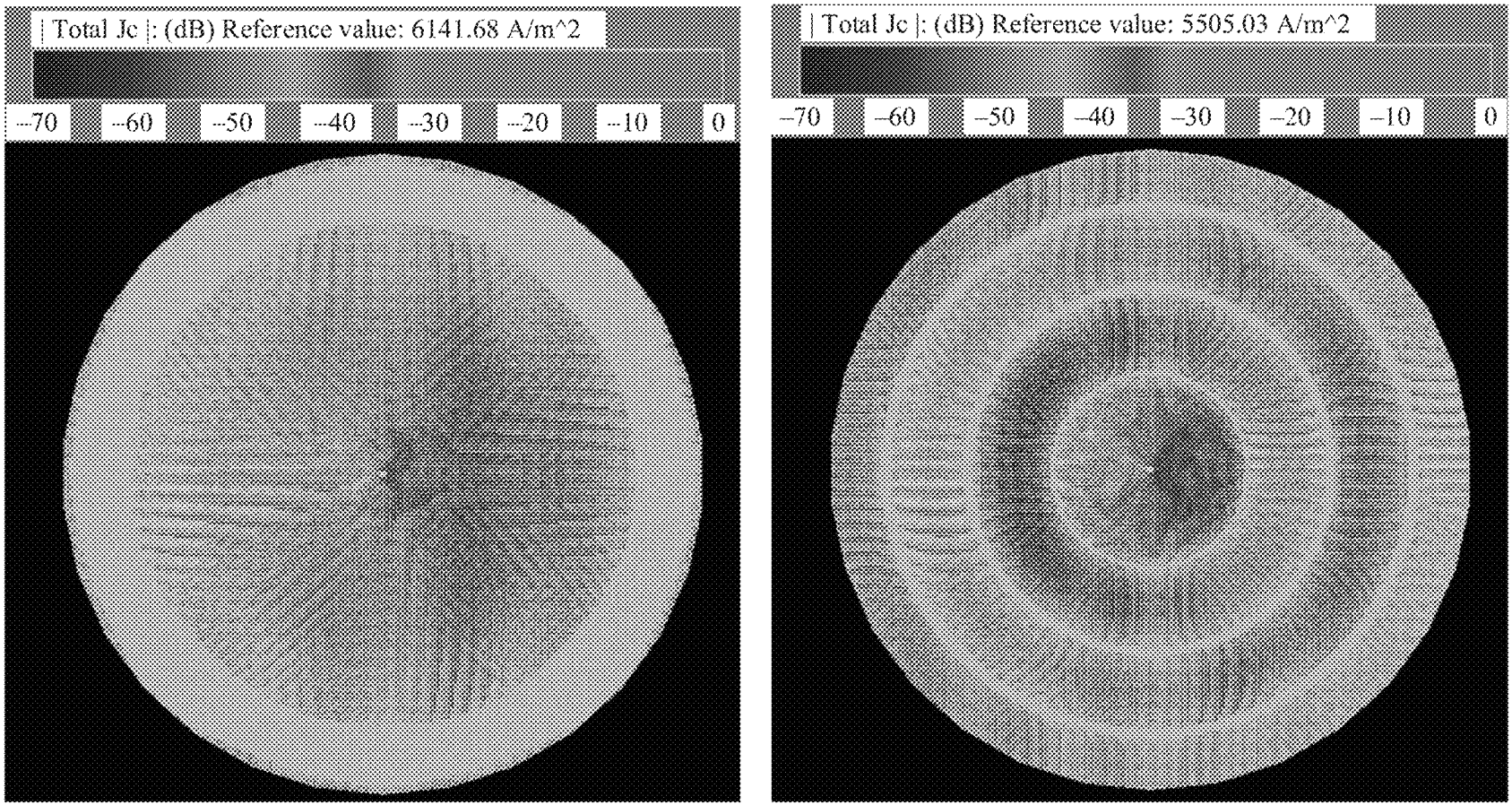
FIG. 3*d* is a schematic simulation diagram of current distribution on a ground plate without a slot according to another embodiment, where in the figure, a left figure is a simulation result of current distribution on the ground plate without a slot in a 2.45 GHz modal, and a right figure is a simulation result of current distribution on the ground plate without a slot in a 5.9 GHz modal.

Referring to FIG. 3*d*, in the figure, a left figure is a current distribution diagram in a 2.45 GHz modal when there is no slot, and a right figure is a current distribution diagram in a 5.9 GHz modal when there is no slot. It can be seen that, when there is no slot, current distribution on the ground plate 10 extends to an edge of the plate.

Figure 3E:
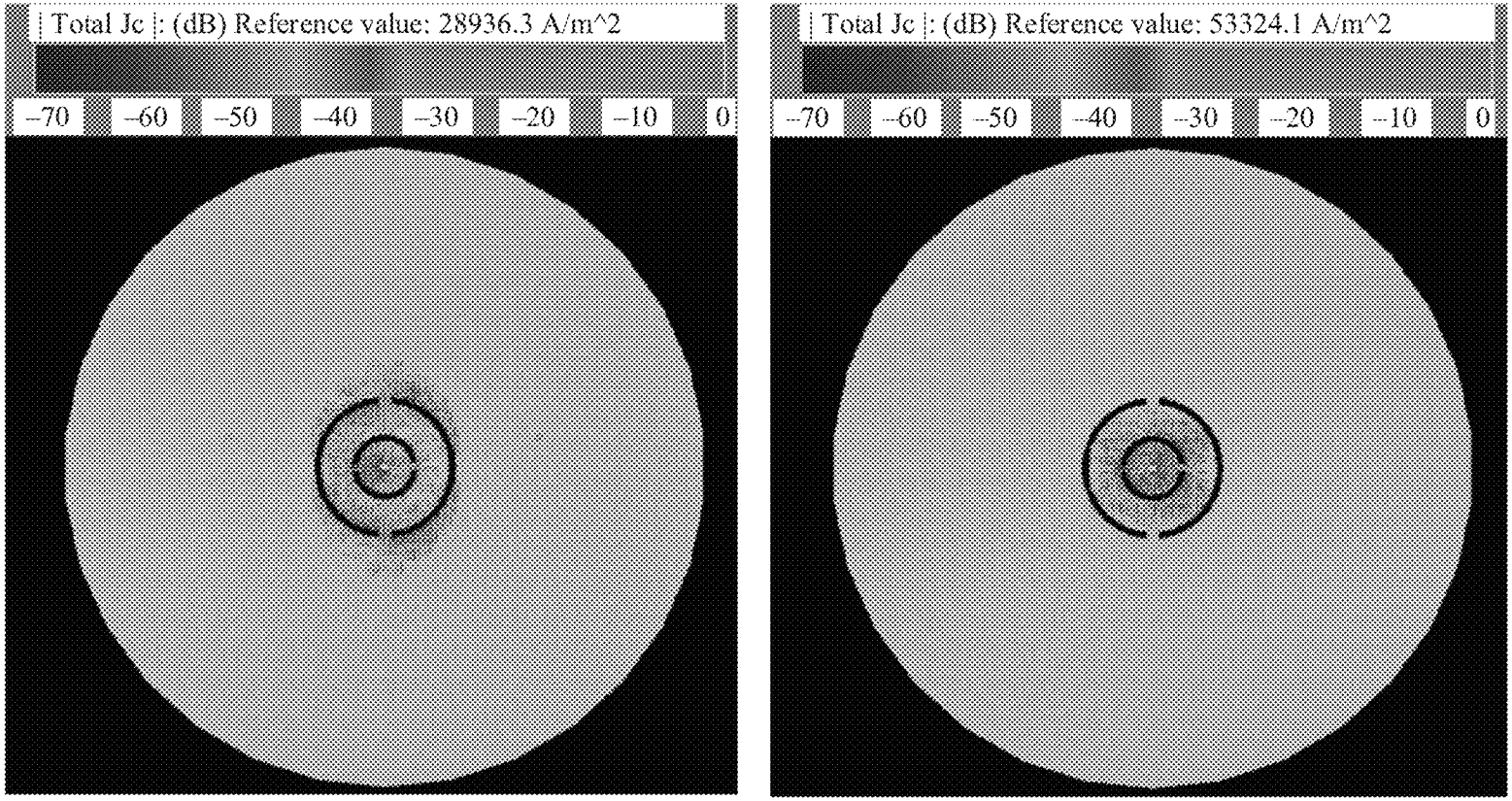
FIG. 3*e* is a schematic simulation diagram of current distribution on a ground plate with a slot according to another embodiment, where in the figure, a left figure is a simulation result of current distribution on the ground plate with a slot in a 2.45 GHz modal, and a right figure is a simulation result of current distribution on the ground plate with a slot in a 5.9 GHz modal.

Referring to FIG. 3*e*, in the figure, a left figure is a current distribution diagram in a 2.45 GHz modal after a slot is disposed, and a right figure is a current distribution diagram in a 5.9 GHz modal after a slot is disposed. It can be seen that most currents on the ground plate 10 are "confined" in and around the slot, a current outside the slot is relatively weak, the slot changes current distribution on the ground plate 10, and further changes a directivity pattern and a horizontal plane gain of the antenna.

Figures 1, 3F:
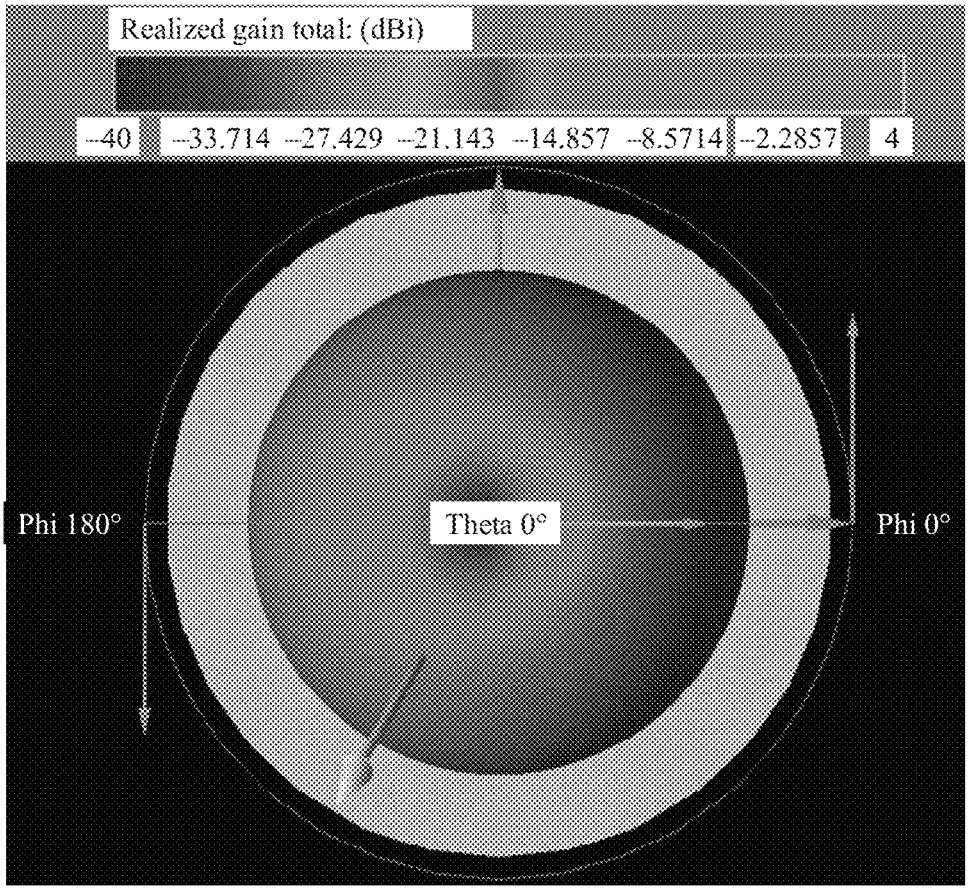
Figures 2, 3F:
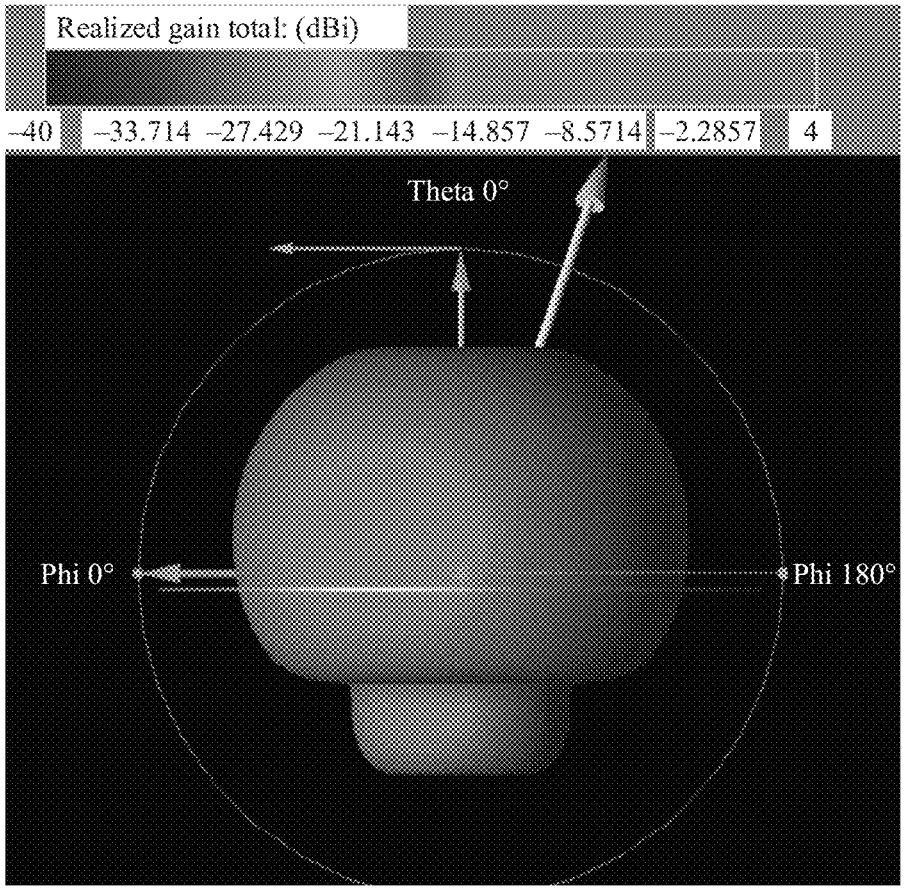
Figures 3, 3F:
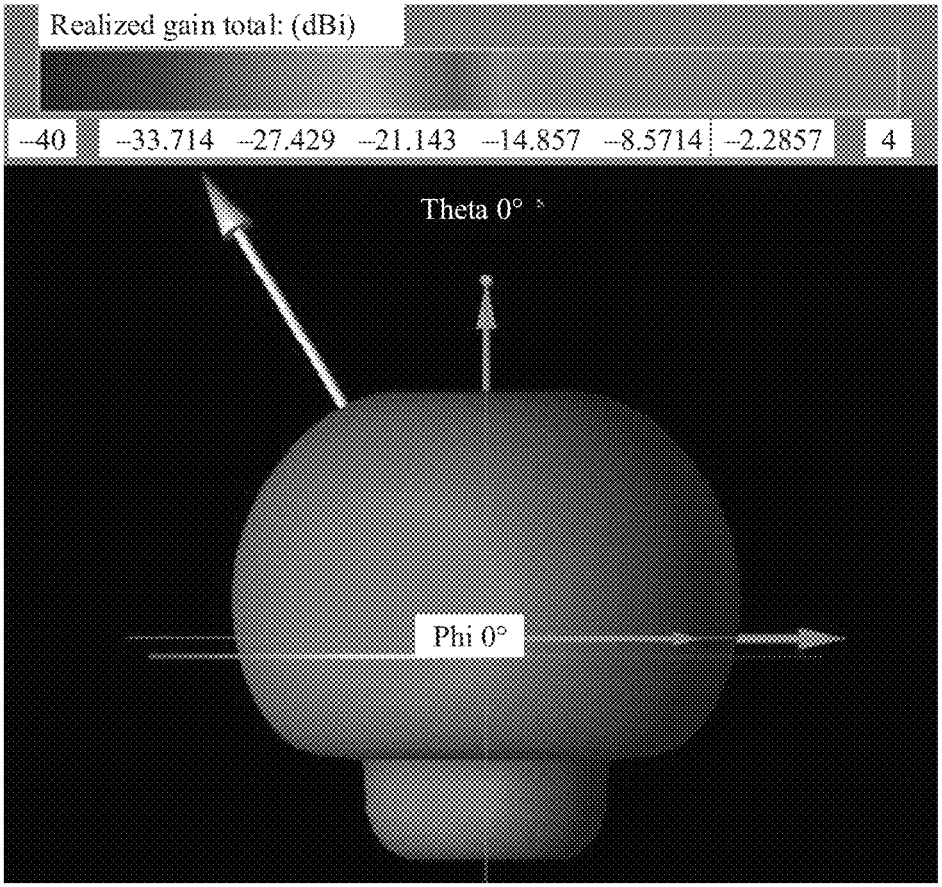

Referring to FIG. 3*f*-1 to FIG. 3*f*-3, in the figures, FIG. 3*f*-1 is a top view of a simulation directivity diagram. FIG. 3*f*-2 is a side view of the simulation directivity diagram, and FIG. 3*f*-3 is a side view of the simulation directivity diagram (vertical to a view angle of FIG. 3*f*-2). When there is no slot, a maximum radiation direction in a 2.45 GHz modal is tilted. Therefore, the maximum radiation direction deviates from a horizontal plane relatively far and a horizontal plane gain decreases.

Figures 1, 3G:
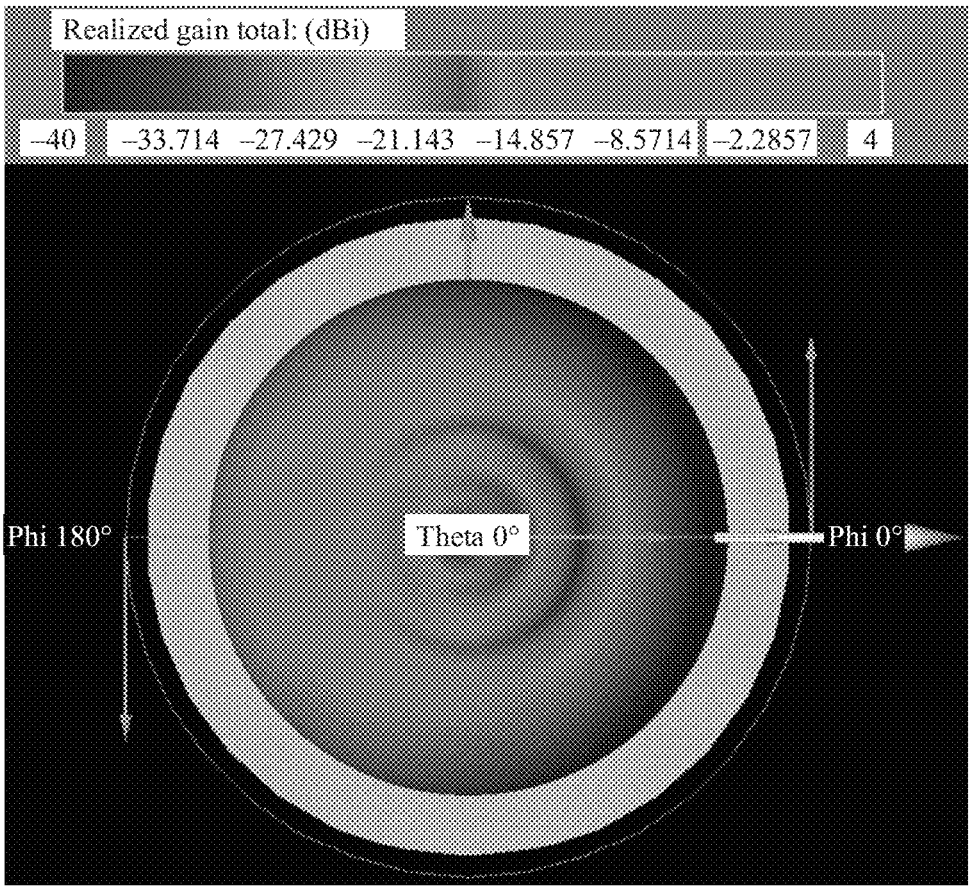
Figures 2, 3G:
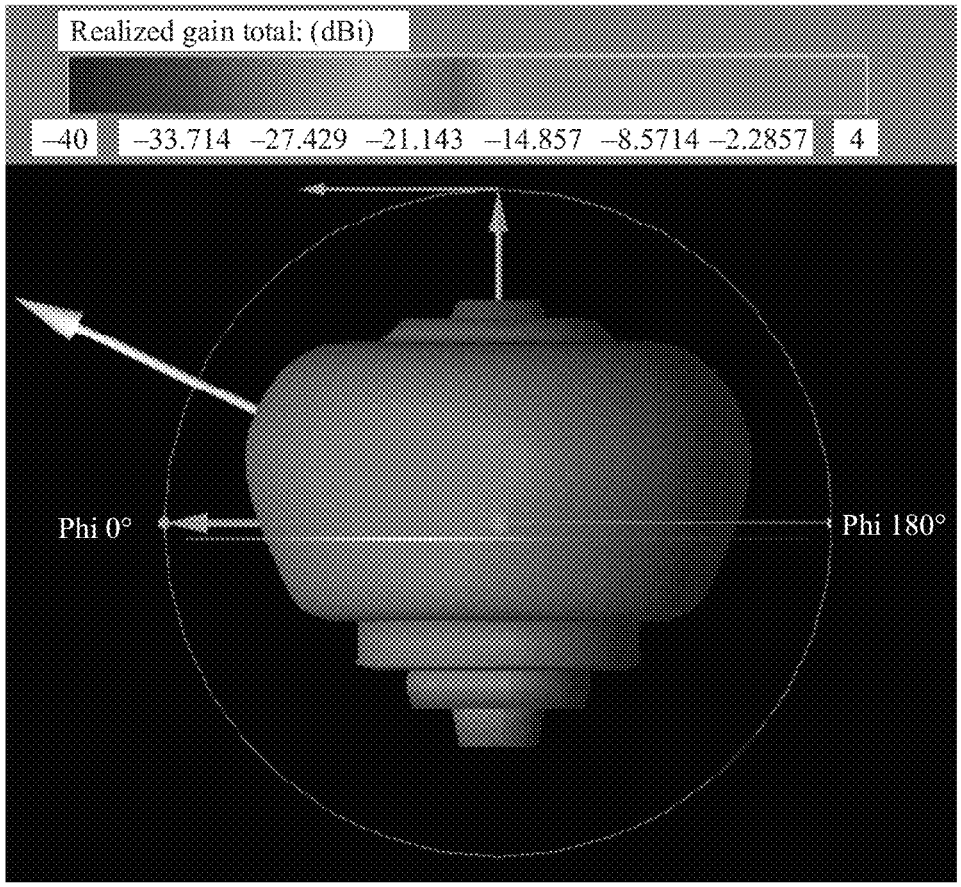
Figures 3, 3G:
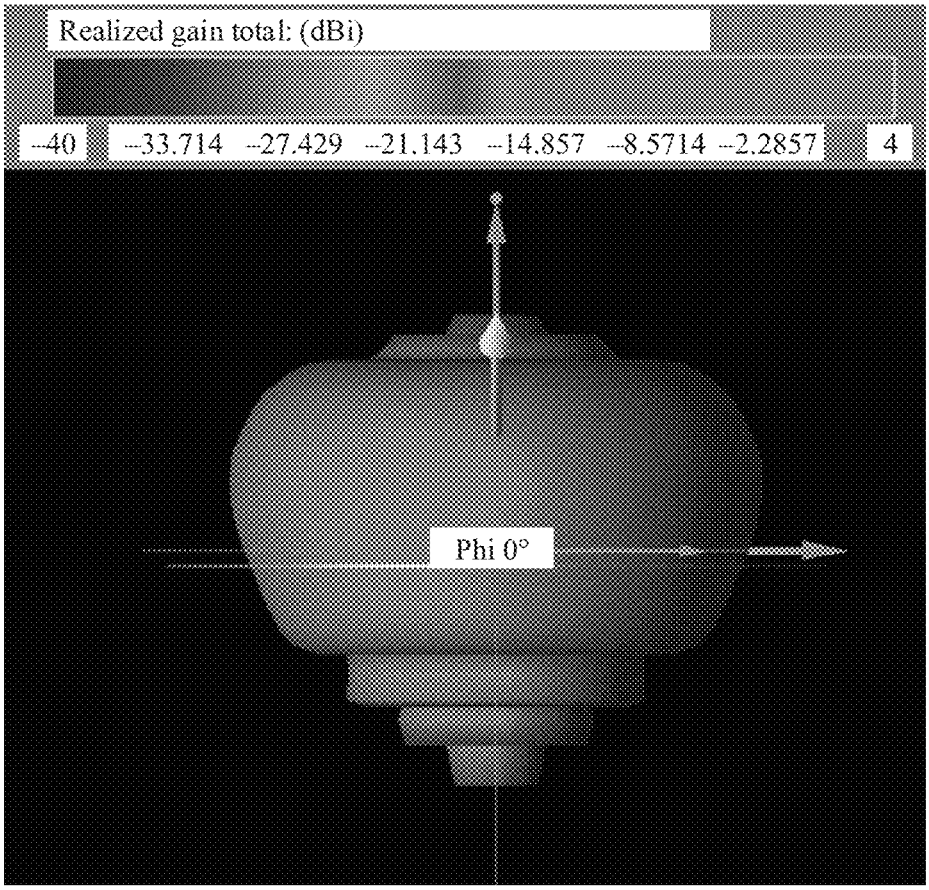

Referring to FIG. 3*g*-1 to FIG. 3*g*-3, in the figures, FIG. 3*g*-1 is a top view of a simulation directivity diagram, FIG. 3*g*-2 is a side view of the simulation directivity diagram, and FIG. 3*g*-3 is a side view of the simulation directivity diagram (vertical to a view angle of FIG. 3*g*-2). When there is no slot, a maximum radiation direction in a 5.9 GHz modal is tilted. Therefore, the maximum radiation direction deviates from a horizontal plane relatively far and a horizontal plane gain decreases.

Figures 1, 3H:
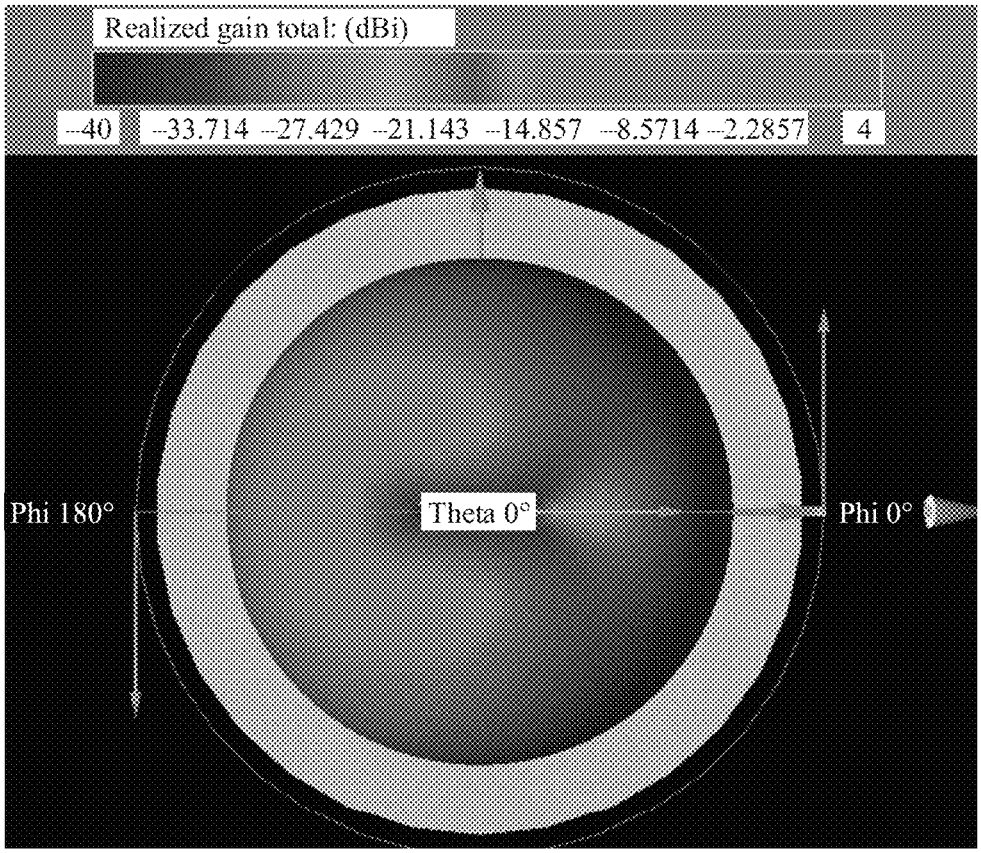
Figures 2, 3H:
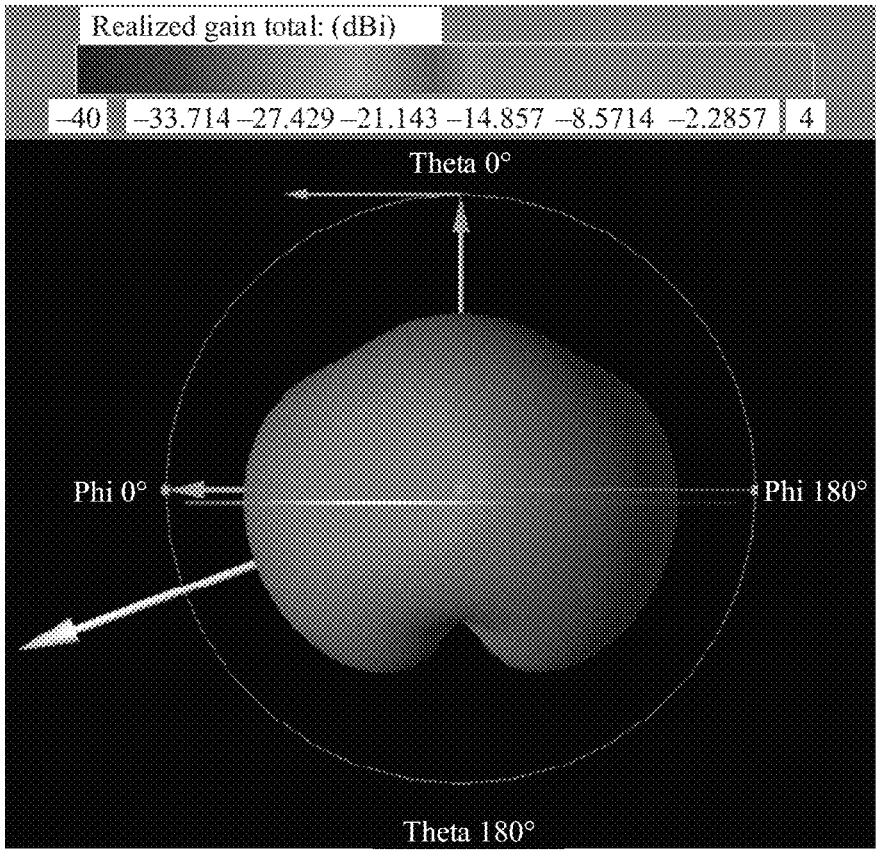
Figures 3, 3H:
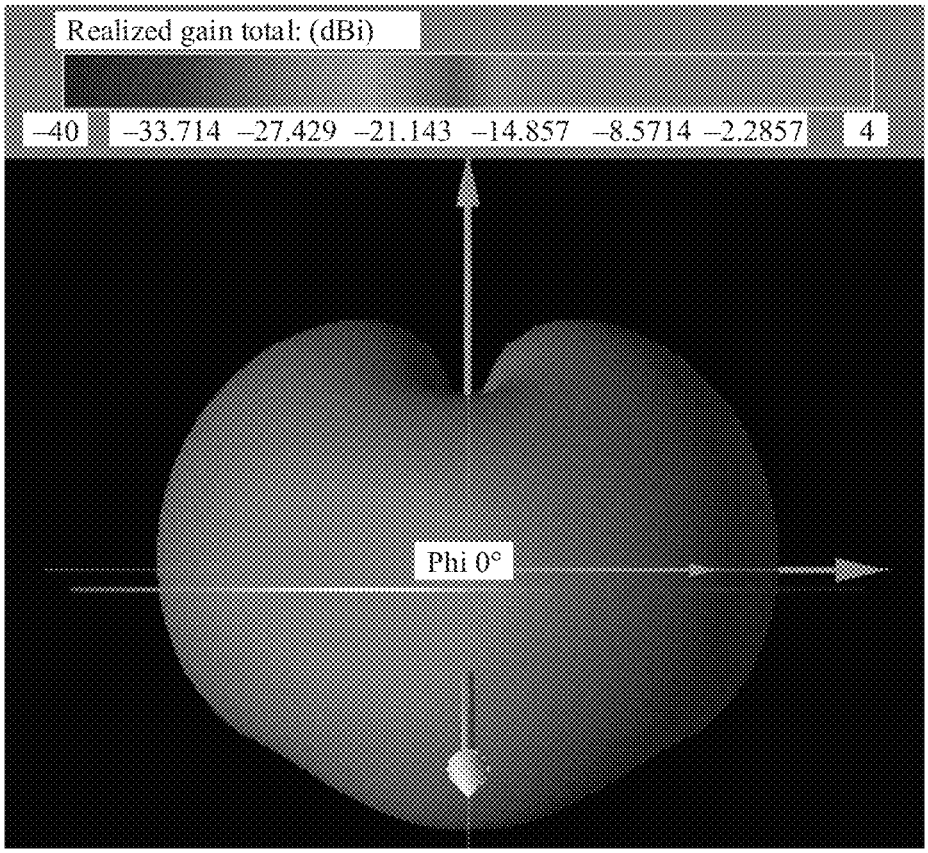

Referring to FIG. 3*h*-1 to FIG. 3*h*-3, in the figures, FIG. 3*h*-1 is a top view of a simulation directivity diagram, FIG. 3*h*-2 is a side view of the simulation directivity diagram, and FIG. 3*h*-3 is a side view of the simulation directivity diagram (vertical to a view angle of FIG. 3*h*-2). After a slot is disposed, a change of current distribution on the ground plate 10 brings a change of a radiation pattern of an antenna in a 2.45 GHz modal, and the radiation pattern of the antenna is pulled down, so that a degree of deviation of a maximum radiation direction of the antenna from a horizontal plane is reduced, and the maximum radiation direction of the antenna is closer to the horizontal plane. This increases a horizontal plane gain.

Figures 1, 3I:
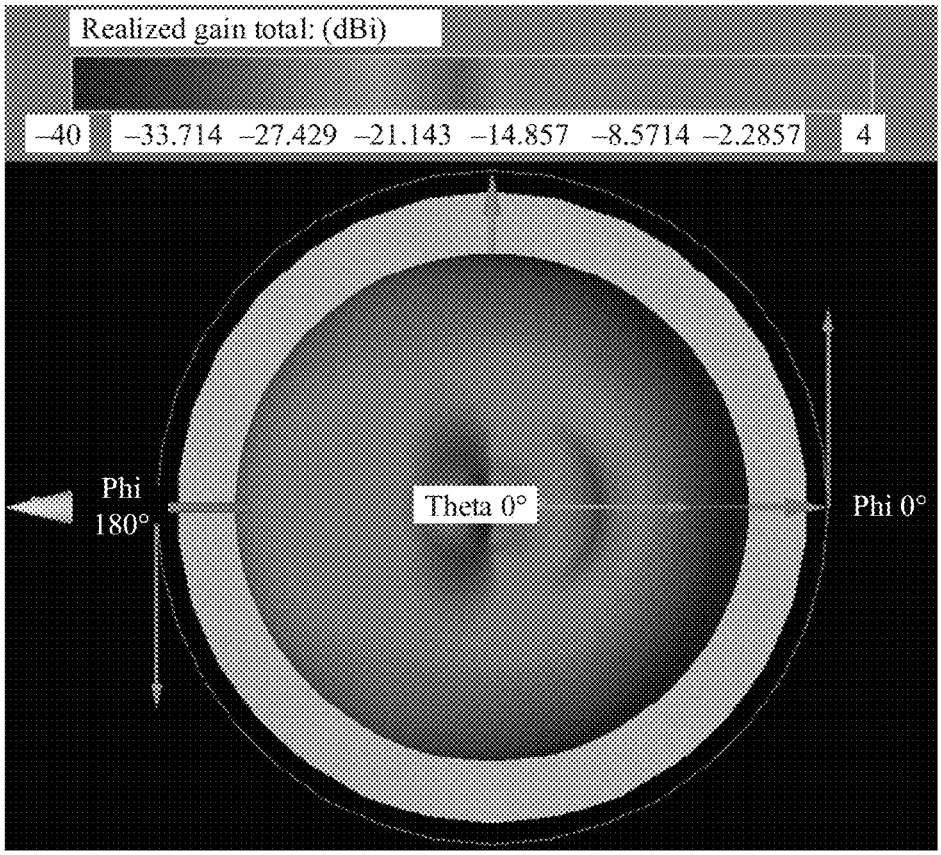
Figures 2, 3I:
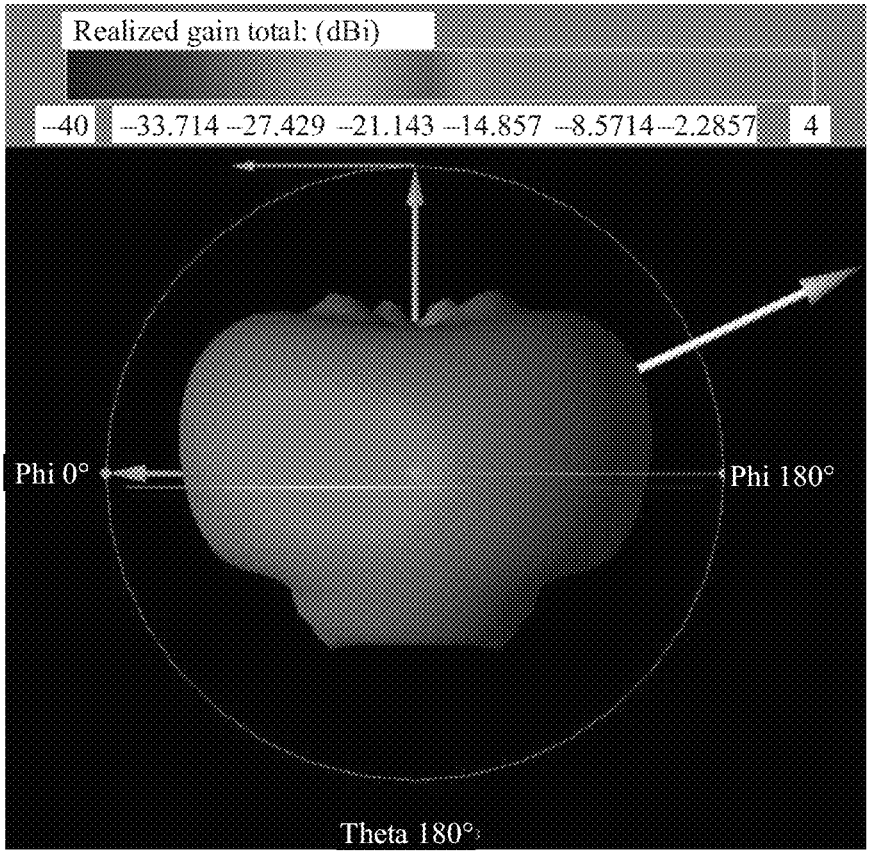
Figures 3, 3I:
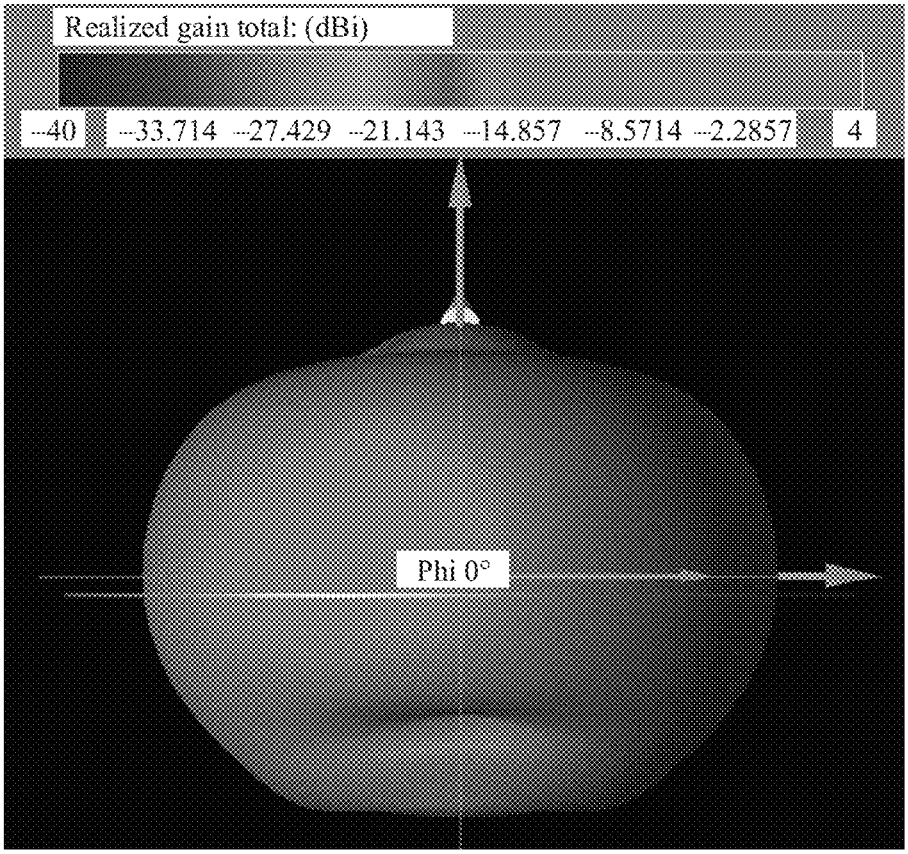

Referring to FIG. 3*i*-1 to FIG. 3*i*-3, in the figures, FIG. 3*i*-1 is a top view of a simulation directivity diagram, FIG. 3*i*-2 is a side view of the simulation directivity diagram, and FIG. 3*i*-3 is a side view of the simulation directivity diagram (vertical to a view angle of FIG. 3*i*-2). After a slot is disposed, a change of current distribution on the ground plate 10 brings a change of a radiation pattern of an antenna in a 5.9 GHz modal, and the radiation pattern of the antenna is pulled down, so that a degree of deviation of a maximum radiation direction of the antenna from a horizontal plane is reduced, and the maximum radiation direction of the antenna is closer to the horizontal plane. This increases a horizontal plane gain.

Figure 3J:
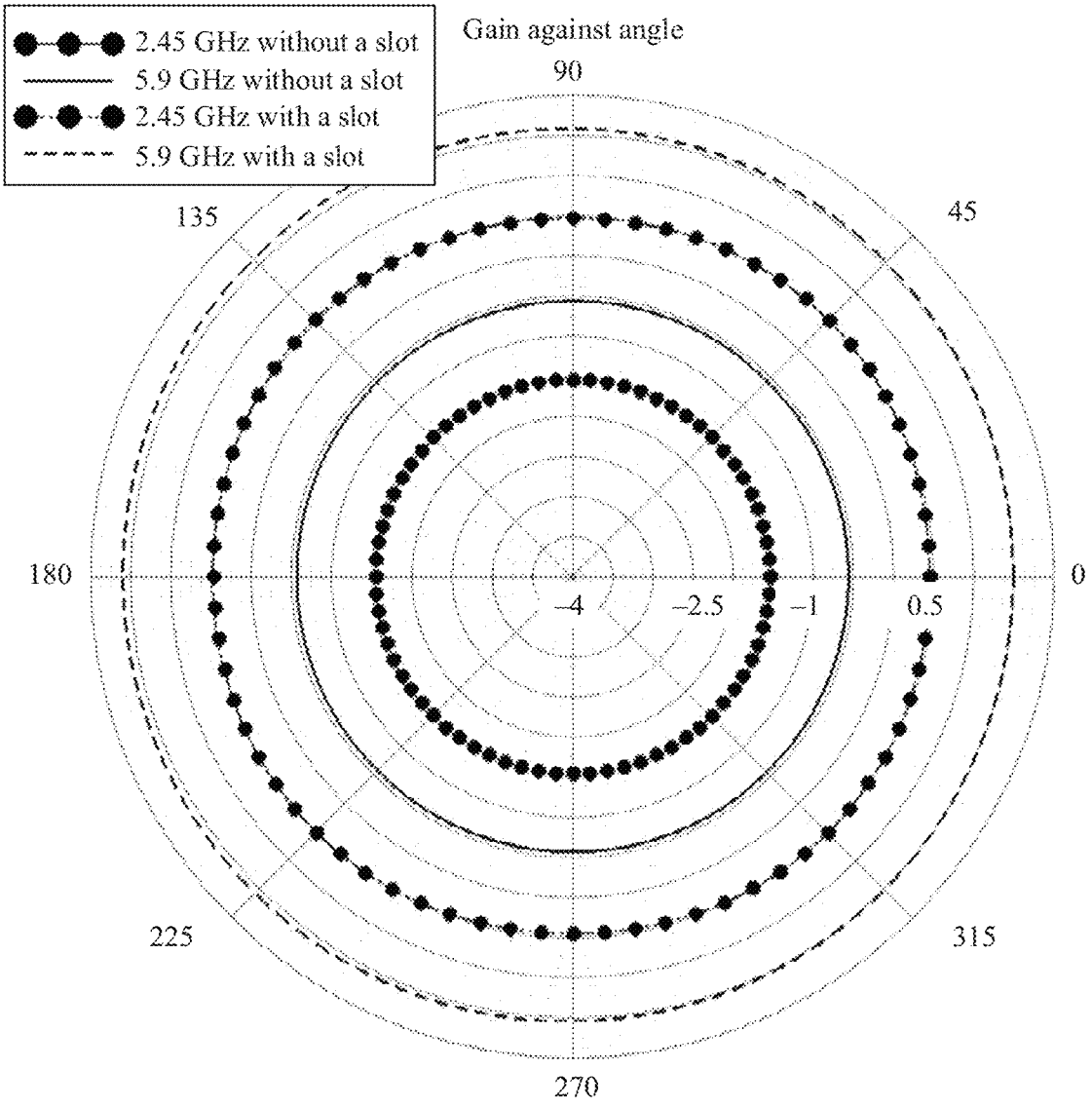
FIG. 3*j* is a schematic comparison diagram of a horizontal plane gain of an antenna apparatus before and after there is a slot in each of a 2.45 GHz modal and a 5.9 GHz modal according to another embodiment.

Referring to FIG. 3*j*, in the figure, a connection line between dots of an inner circle indicates a horizontal plane gain in a 2.45 GHz modal when there is no slot, a connection line between dots of an outer circle indicates a horizontal plane gain in the 2.45 GHz modal after a slot is disposed, a solid line of an inner circle indicates a horizontal plane gain in a 5.9 GHz modal when there is no slot, and a dashed line of an outer circle indicates a horizontal plane gain in the 5.9 GHz modal after a slot is disposed. It can be seen that the horizontal plane gain in each of the two modalities is increased by more than 2 dB after the slot is disposed.

Figure 4A:
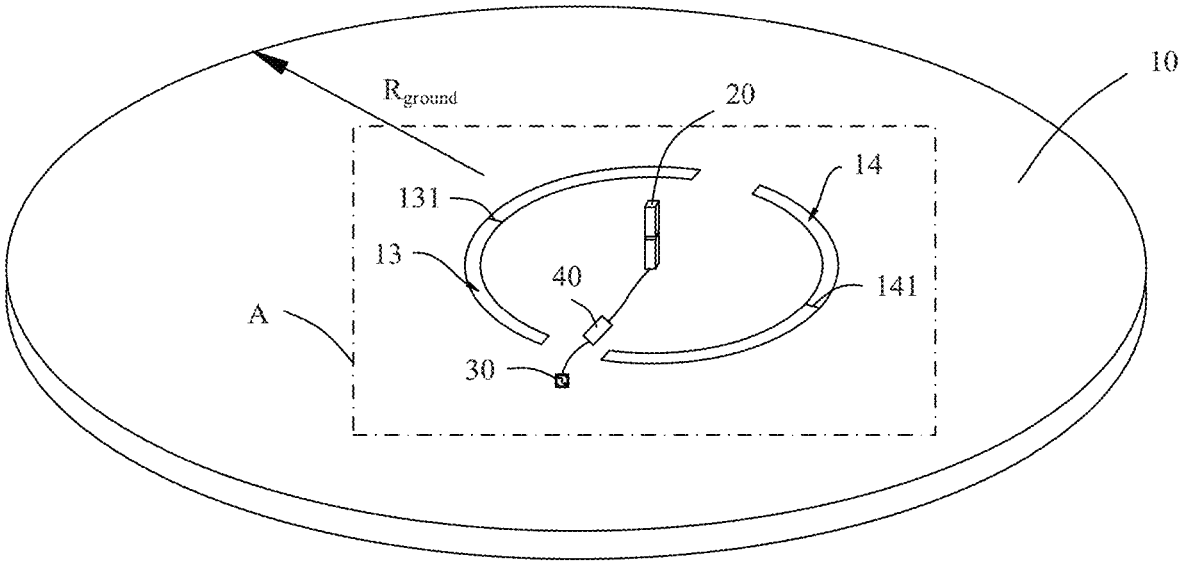
FIG. 4*a* is a schematic structural diagram of an antenna apparatus according to another embodiment.
Figure 4B:
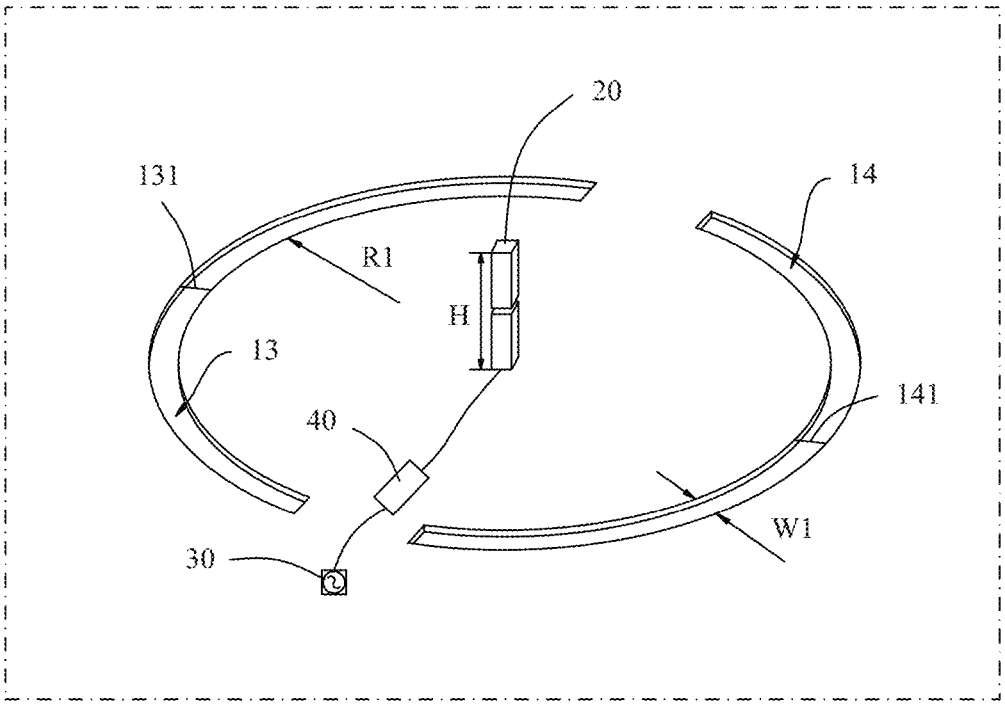
FIG. 4*b* is a schematic diagram of a partially enlarged structure at A in FIG. 4*a;*

Referring to FIG. 4*a* and FIG. 4*b*, another embodiment of the present invention provides an antenna apparatus, including a ground plate 10, a radiator 20, and a signal source 30, where the radiator 20 is disposed on the ground plate 10. The antenna apparatus may further include a matching circuit 40, where the matching circuit 40 is electrically connected between the radiator 20 and the signal source 30, and is configured to adjust a resonance state of the radiator 20. The signal source 30 is configured to feed electromagnetic wave signals of a first frequency band and a second frequency band into the radiator 20, where the second frequency band is lower than the first frequency band, a third slot 13 and a fourth slot 14 are disposed on the ground plate 10, and both the third slot 13 and the fourth slot 14 are closed slots and surround the radiator 20. The antenna apparatus further includes a first filter 131 and a second filter 141, where the first filter 131 is disposed in the third slot 13 and divides the third slot 13 into two slots, the second filter 141 is disposed in the fourth slot 14 and divides the fourth slot 14 into two slots, and the first filter 131 and the second filter 141 enable the third slot 13 and the fourth slot 14 to each form two different electrical lengths, so that currents generated by the electromagnetic wave signals of the first frequency band and the second frequency band can be confined in and around the third slot 13 and the fourth slot 14.

The third slot 13 and the fourth slot 14 surrounding the radiator 20 are disposed to prevent the current from flowing to an edge of the ground plate 10. The first filter 131 and the second filter 141 are disposed, so that two different electrical lengths are generated in the third slot 13 and two different electrical lengths are generated in the fourth slot 14. Therefore, the radiator 20 generates resonance in two modalities of the first frequency band and the second frequency band, to meet a multi-frequency communication requirement. In addition, because the current is confined to the third slot 13 and the fourth slot 14, horizontal plane gains of the electromagnetic wave signals of the first frequency band and the second frequency band are increased. The complete third slot 13 and the complete fourth slot 14 are used to confine the current generated by the electromagnetic wave signal of the second frequency band, and the first filter 131 and the second filter 141 are added, so that the current generated by the electromagnetic wave signal of the first frequency band can be also restrained by the antenna apparatus, and is confined to a part of the third slot 13 and a part of the fourth slot 14.

The third slot 13 and the fourth slot 14 in this embodiment are basically the same as those in the embodiment shown in FIG. 3*a* and FIG. 3*b*. This is equivalent to canceling the first slot 11 and the second slot 12 in FIG. 3*a* and FIG. 3*b*, and the first filter 131 and the second filter 141 are added to the third slot 13 and the fourth slot 14.

Both the first filter 131 and the second filter 141 are band-pass filters in which an inductor and a capacitor are connected in series, and are configured to enable the current generated by the electromagnetic wave signal of the second frequency band to pass and block the current generated by the electromagnetic wave signal of the first frequency band, so that an electrical length of the electromagnetic wave signal of the second frequency band is greater than an electrical length of the electromagnetic wave signal of the first frequency band. The first filter 131 and the second filter 141 are disposed as the band-pass filters, so that the two electrical lengths are generated in the third slot 13, the two electrical lengths are generated in the fourth slot 14, the entire third slot 13 is the electrical length of the second frequency band with a lower frequency, and a part of the third slot 13 is the electrical length of the first frequency band with a higher frequency. The other part is not used to confine the electromagnetic wave signal of the first frequency band because no current flows through the other part due to a blocking effect of the first filter 131. The fourth slot 14 is similar to this, and details are not described.

A specific location of the first filter 131 disposed in the third slot 13 and a specific location of the second filter 141 disposed in the fourth slot 14 are related to a wavelength $\lambda_1$ of the electromagnetic wave signal of the first frequency band. Specifically, the first filter 131 is disposed at $0.5x\lambda_1$ away from an endpoint of the third slot 13, and the second filter 141 is disposed $0.5x\lambda_1$ away from an endpoint of the fourth slot 14. Through the foregoing settings, $0.5x\lambda_1$ is the first electrical length of the electromagnetic wave signal of the first frequency band, and $0.5x\lambda_2$ is the second electrical length of the electromagnetic wave signal of the second frequency band, where $\lambda_1$ is the wavelength of the electromagnetic wave signal of the first frequency band, and $\lambda_2$ is the wavelength of the electromagnetic wave signal of the second frequency band.

The third slot 13 and the fourth slot 14 are symmetrically disposed by using a joint between the radiator 20 and the ground plate 10 as a center. The third slot 13 and the fourth slot 14 that are symmetrically centered may enable that current distribution almost the same is generated on the ground plate 10 around the radiator 20, so that shapes of radiation patterns of an antenna in all directions around the radiator 20 are almost the same.

A radial distance from the radiator 20 to the third slot 13 ranges from $0.2x\lambda_2$ to $0.3x\lambda_2$, and $\lambda_2$ is the wavelength of the electromagnetic wave signal of the second frequency band. The distance between the third slot 13 and the radiator 20 is set to $0.2x\lambda_2$ to $0.3x\lambda_2$, and a current flows from the radiator 20 to the third slot 13. When flowing through the distance of $0.2x\lambda_2$ to $0.3x\lambda_2$, the current is relatively weak, an electric field is relatively strong, resonance is generated, and the current is confined in and around the third slot 13, so that resonance is generated at the third slot 13 after currents of the electromagnetic wave signals of the first frequency band and the second frequency band flow through the path, and the current is confined in and around the third slot 13.

The third slot 13 is arc shaped, a distance between an inner side of the third slot 13 and a center of the radiator 20 is a first radius R1, and the first radius is $0.25x\lambda_2$. The first radius R1 is $0.25x\lambda_2$, so that resonance can be generated at the third slot 13 after the current of the electromagnetic wave signal of the first frequency band flows through the path. Because at $0.25x\lambda_2$, the current is the smallest, the electric field is the strongest, and a resonance effect is the best, the current is confined in and around the third slot 13.

A length of the third slot 13 extending in a circumference direction is a first electrical length, and the first electrical length is $0.5x\lambda_2$. The first electrical length is set to $0.5x\lambda_2$, so that resonance is generated at the third slot 13 when the current of the electromagnetic wave signal of the second frequency band flows to the third slot 13.

A length of the third slot 13 in a radial direction is a first width W1, the first width W1 is $0.05x\lambda_1$, $\lambda_1$ is the wavelength of the electromagnetic wave signal of the first frequency band, the first frequency band is 5.9 GHz, and the second frequency band is 2.45 GHz. The first width W1 is set to $0.05x\lambda_1$, to obtain the first frequency band 5.9 GHz and the second frequency band 2.45 GHz meeting an operating frequency band range of the antenna. In the field of terminals such as a vehicle-mounted antenna, the frequencies 2.45 GHz and 5.9 GHz are both common communication frequencies, and the frequencies 2.45 GHz and 5.9 GHz obtained through the foregoing settings are both within a preferred frequency band range of the vehicle-mounted antenna, so that a relatively good wireless communication effect can be implemented.

In this embodiment, the radiator 20 preferably uses a monopole antenna, and a height of the radiator 20 is preferably $0.25x\lambda_2$.

With reference to FIG. 4*a* and FIG. 4*b*, a specific embodiment is provided. The ground plate 10 is a circle, a radius $R_{ground}$ of the ground plate 10 is 100 mm, the radiator 20 is a monopole antenna, a height H of the radiator 20 is 20 mm, a first radius R1 is 20 mm, and a first electrical length is 40 mm, a first width W1 is 2 mm. Both the first filter 131 and the second filter 141 are band-pass filters in which an inductor of 3.6 nH and a capacitor of 0.2 pF are connected in series. The antenna apparatus is simulated, and for a simulation result, refer to subsequent descriptions.

Figure 4C:
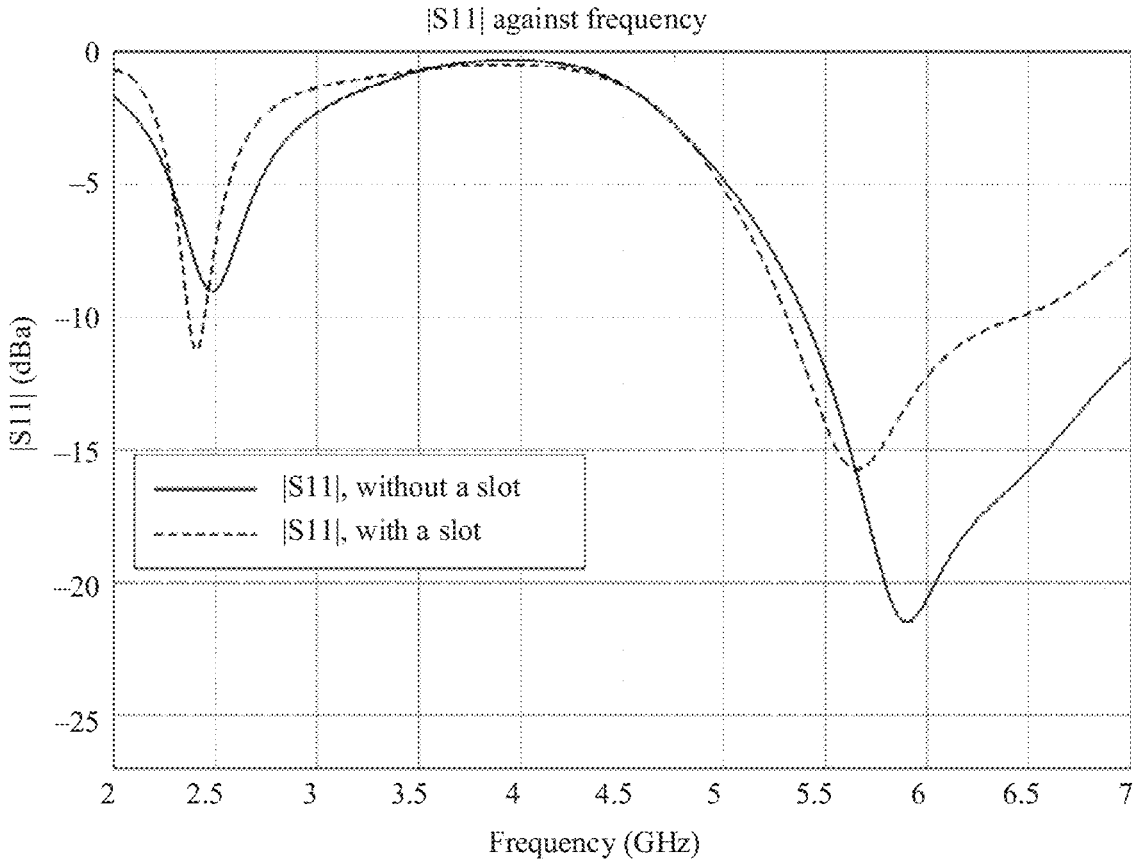
FIG. 4*c* is a schematic simulation diagram of a return loss (S 11) of an antenna apparatus according to another embodiment.

Referring to FIG. 4*c*, in the figure, a solid line is an S11 curve of an antenna when there is no slot, and a dashed line is an S11 curve of an antenna added with a filter after a slot is disposed. It can be seen that, after the slot is disposed and the filter is added, locations of two generated resonance points are close to the expected first frequency band 2.45 GHz and the expected second frequency band 5.9 GHz. In this way, the antenna apparatus is disposed.

Figure 4D:
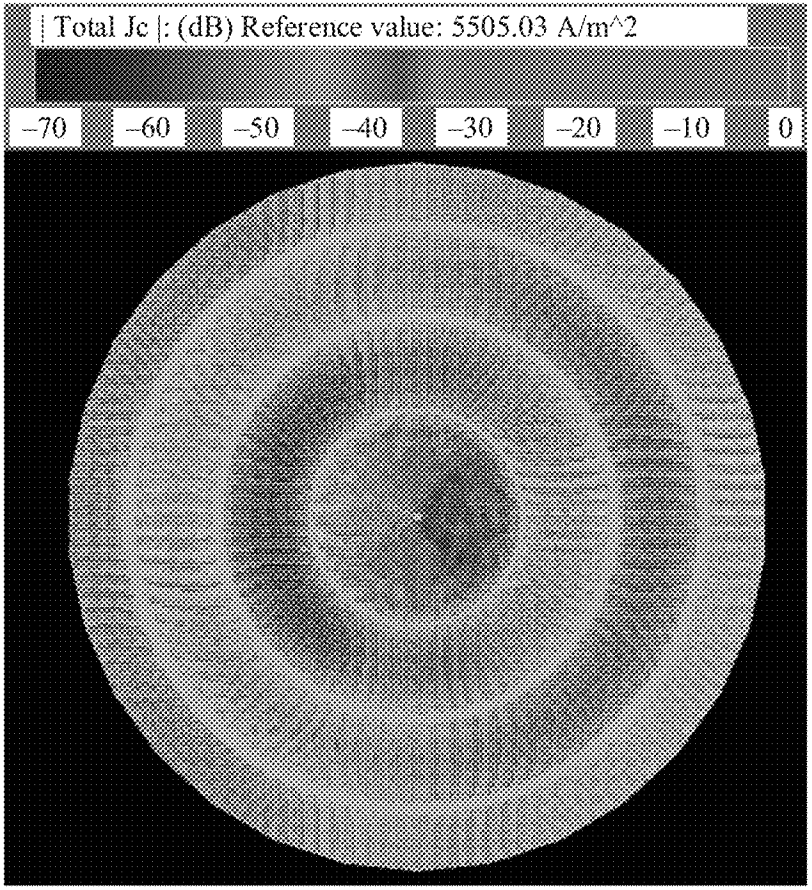
FIG. 4*d* is a schematic simulation diagram of current distribution on a ground plate without a slot according to another embodiment, where in the figure, a left figure is a simulation result of current distribution on the ground plate without a slot in a 2.45 GHz modal, and a right figure is a simulation result of current distribution on the ground plate without a slot in a 5.9 GHz modal.
Figure 4D:
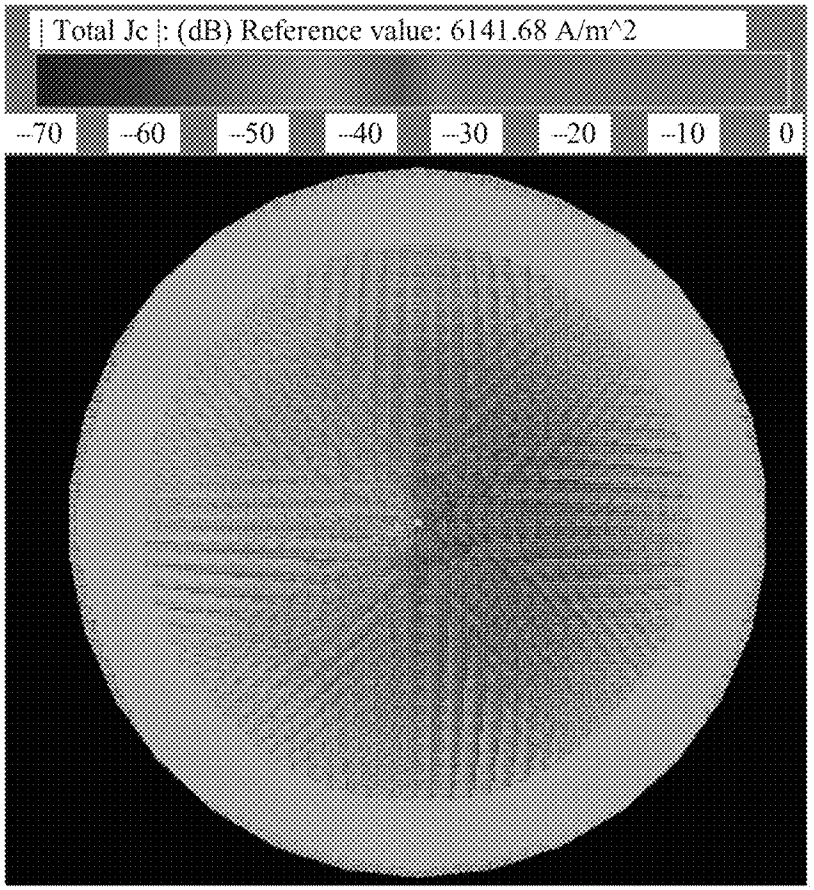

Referring to FIG. 4*d*, a left figure in the figure is a current distribution diagram in a 2.45 GHz modal when there is no slot, and a right figure in the figure is a current distribution diagram in a 5.9 GHz modal when there is no slot. It can be seen that, when there is no slot, current distribution on the ground plate 10 extends to an edge of the plate.

Figure 4E:
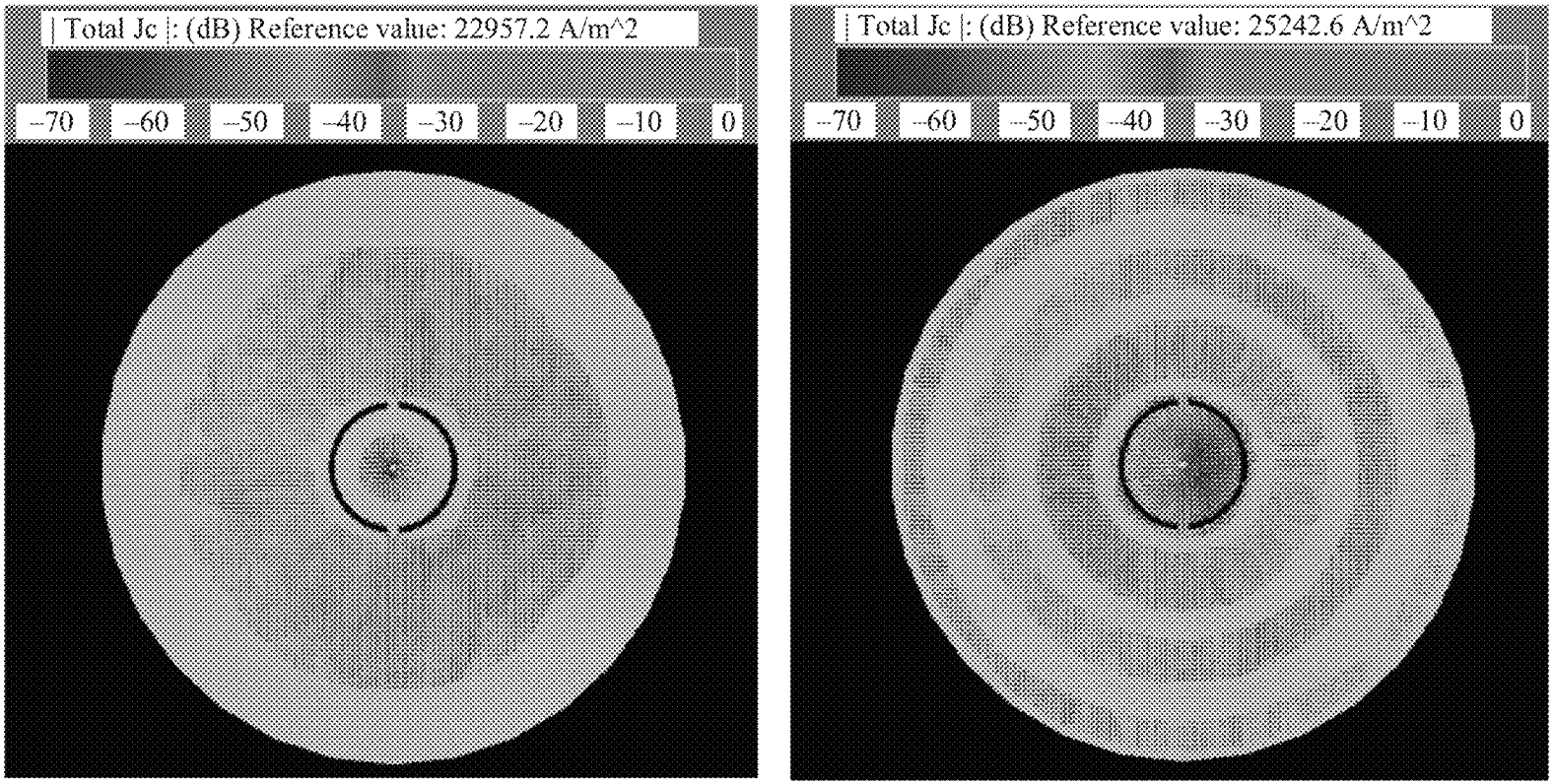
FIG. 4*e* is a schematic simulation diagram of current distribution on a ground plate with a slot according to another embodiment, where in the figure, a left figure is a simulation result of current distribution on the ground plate with a slot in a 2.45 GHz modal, and a right figure is a simulation result of current distribution on the ground plate with a slot in a 5.9 GHz modal.

Referring to FIG. 4*e*, in the figure, a left figure is a current distribution diagram in a 2.45 GHz modal after a slot is disposed and a filter is added, and a right figure is a current distribution diagram in a 5.9 GHz modal after a slot is disposed and a filter is added. It can be seen that, after the slot is added and the filter is added, a current on the ground plate 10 is "confined" to some extent in and around the slot, and a current outside the slot becomes weak. The slot can improve current distribution of 2.45 GHz, and the filter added at a specific location of the slot enables a current of 5.9 GHz to generate resonance at the slot, in other words, after the filter is added to the same slot, currents in two modalities generate resonance around the slot. This changes current distribution on the ground plate 10, and further changes a directivity pattern and a horizontal plane gain of the antenna.

Figures 1, 4F:
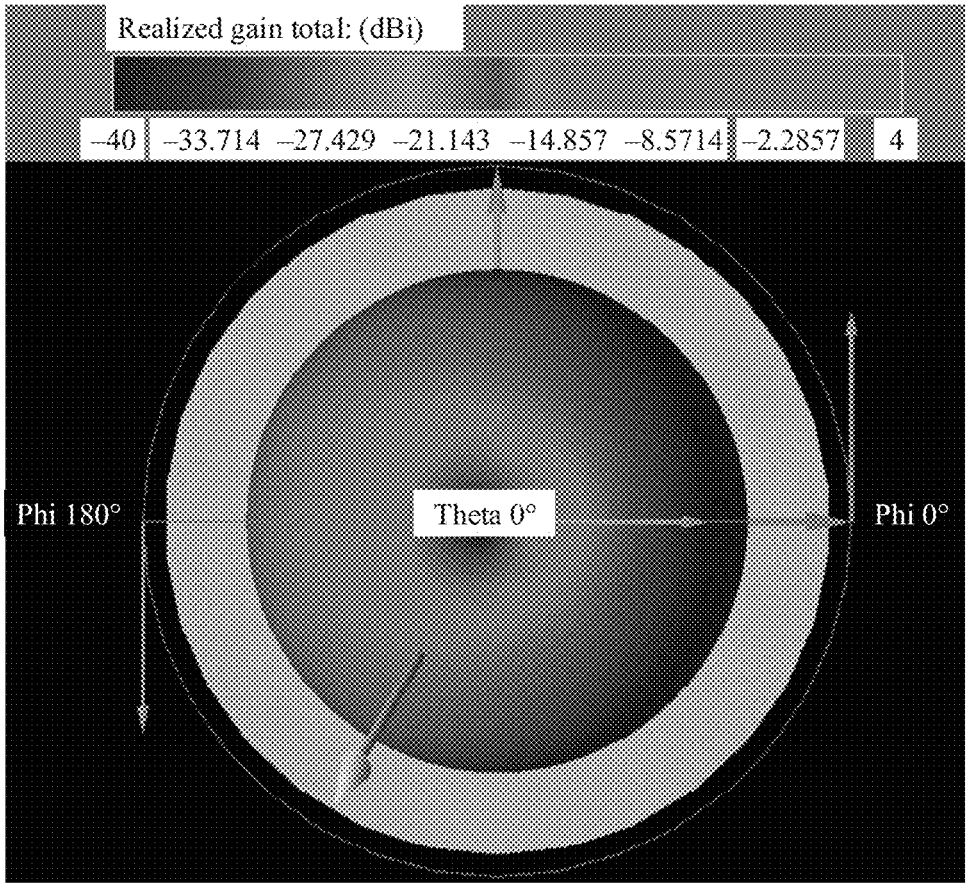
Figures 2, 4F:
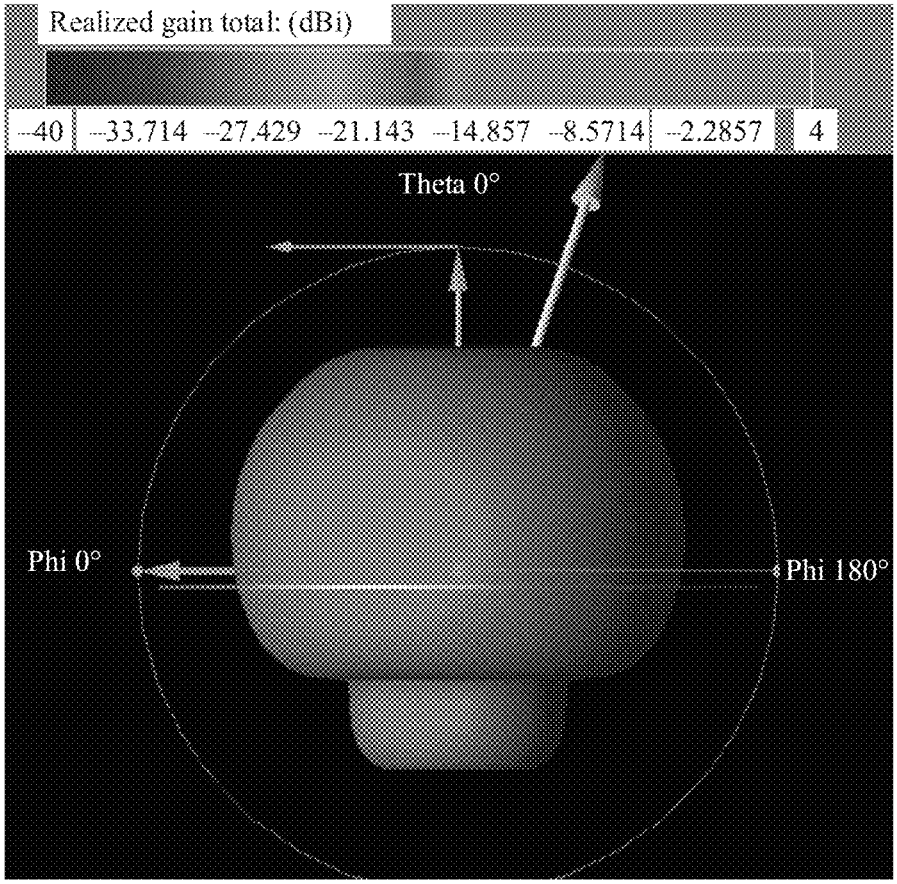
Figures 3, 4F:
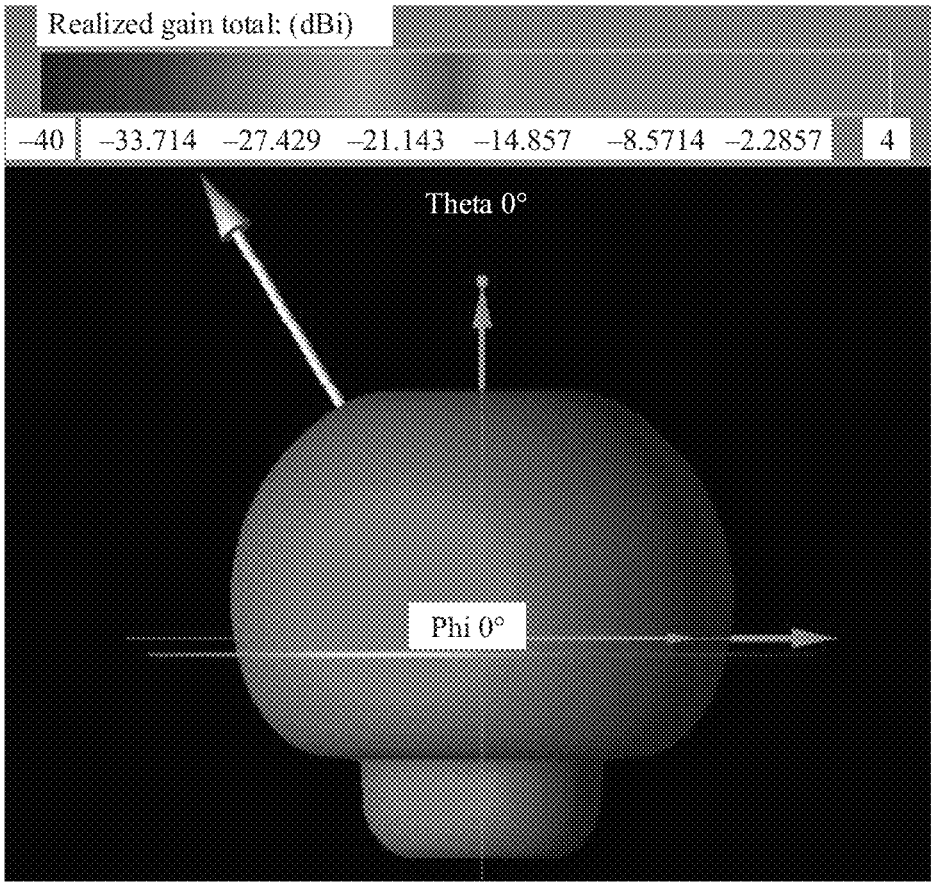

Referring to FIG. 4*f*-1 to FIG. 4*f*-3, in the figures, FIG. 4*f*-1 is a top view of a simulation directivity diagram. FIG. 4*f*-2 is a side view of the simulation directivity diagram, and FIG. 4*f*-3 is a side view of the simulation directivity diagram (vertical to a view angle of FIG. 4*f*-2). When there is no slot, a maximum radiation direction in a 2.45 GHz modal is tilted. Therefore, the maximum radiation direction deviates from a horizontal plane relatively far and a horizontal plane gain decreases.

Figures 1, 4G:
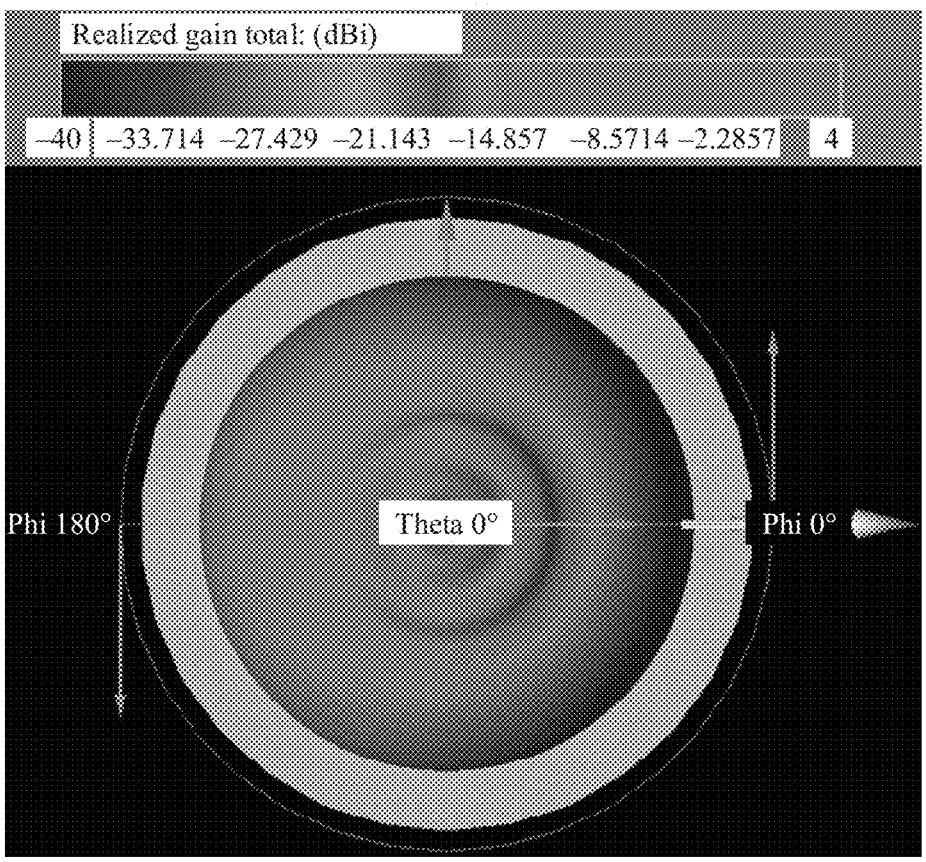
Figures 2, 4G:
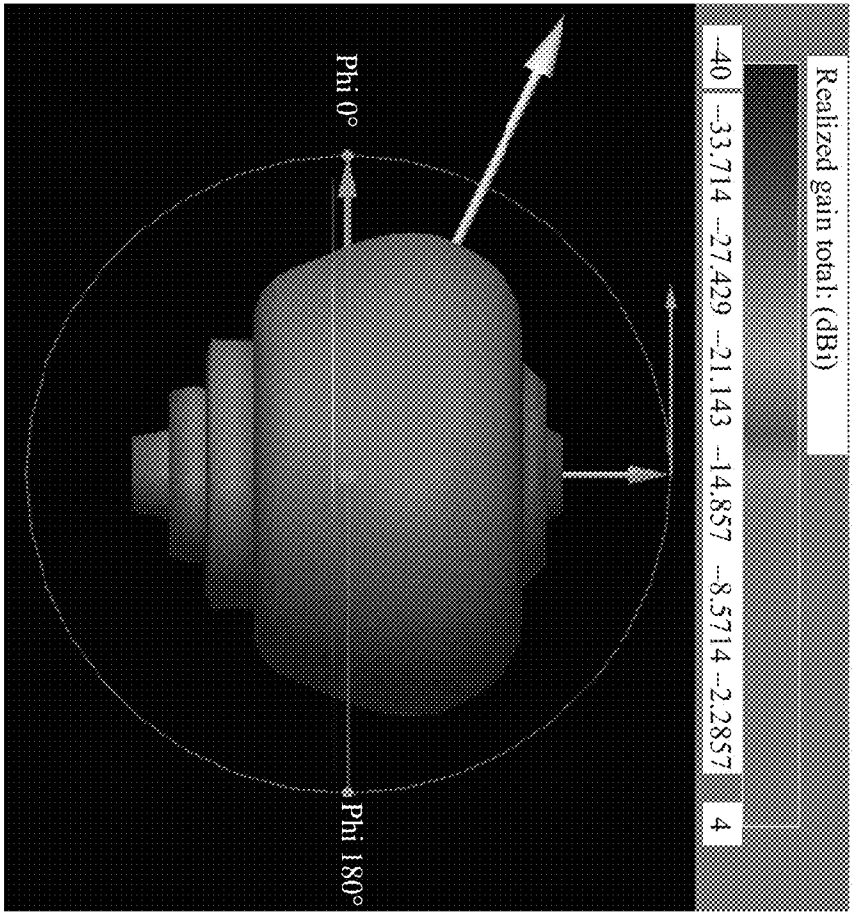
Figures 3, 4G:
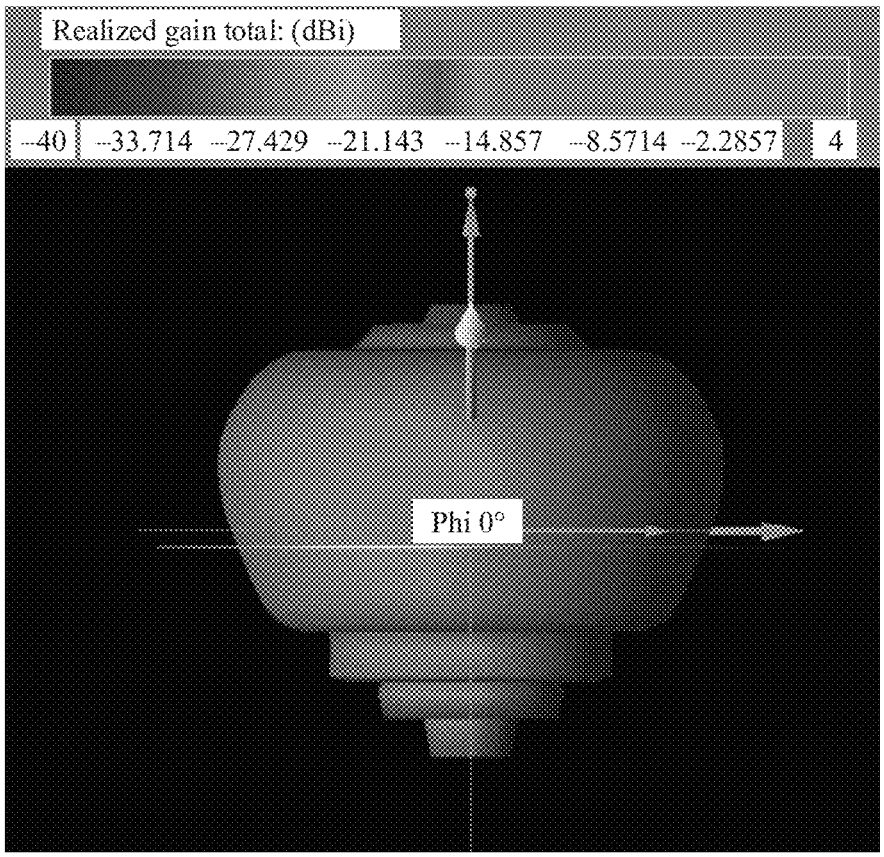

Referring to FIG. 4*g*-1 to FIG. 4*g*-3, in the figures, FIG. 4*g*-1 is a top view of a simulation directivity diagram. FIG. 4*g*-2 is a side view of the simulation directivity diagram, and FIG. 4*g*-3 is a side view of the simulation directivity diagram (vertical to a view angle of FIG. 4*g*-2). When there is no slot, a maximum radiation direction in a 5.9 GHz modal is tilted. Therefore, the maximum radiation direction deviates from a horizontal plane relatively far and a horizontal plane gain decreases.

Figures 1, 4H:
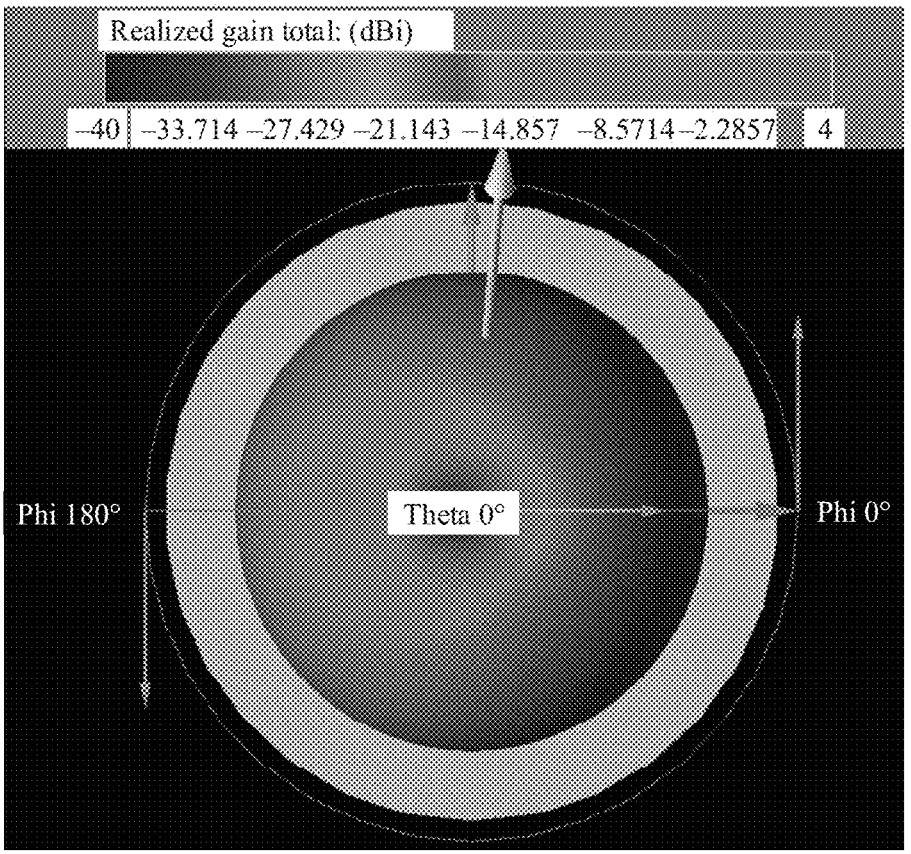
Figures 2, 4H:
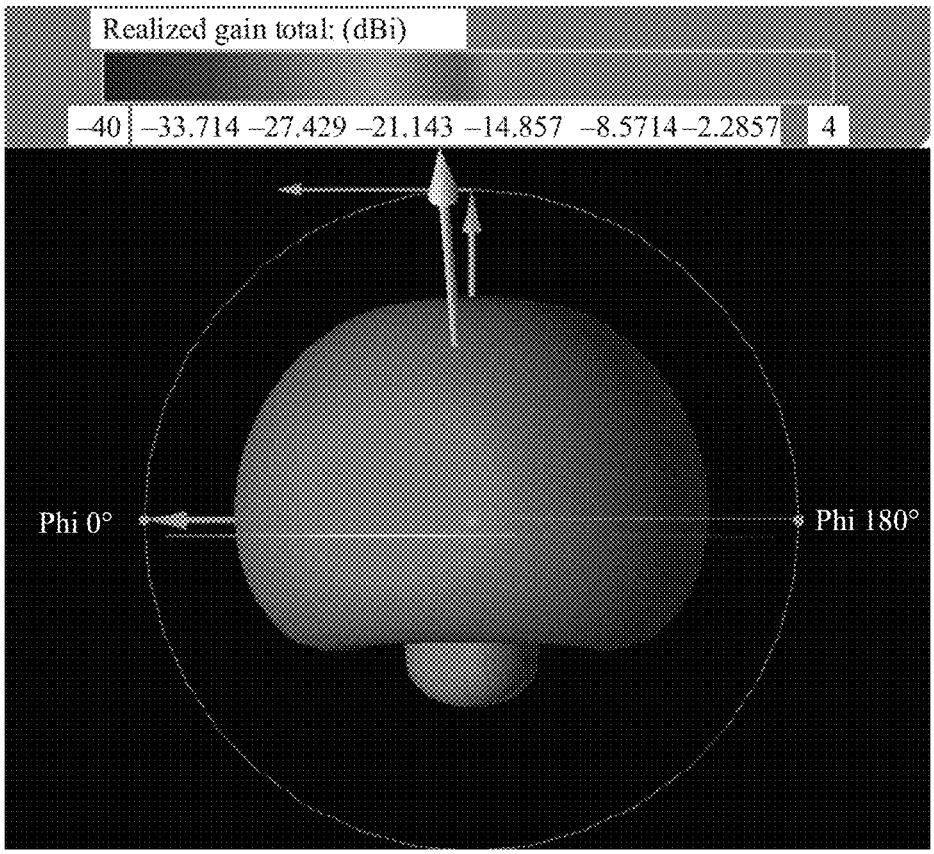
Figures 3, 4H:
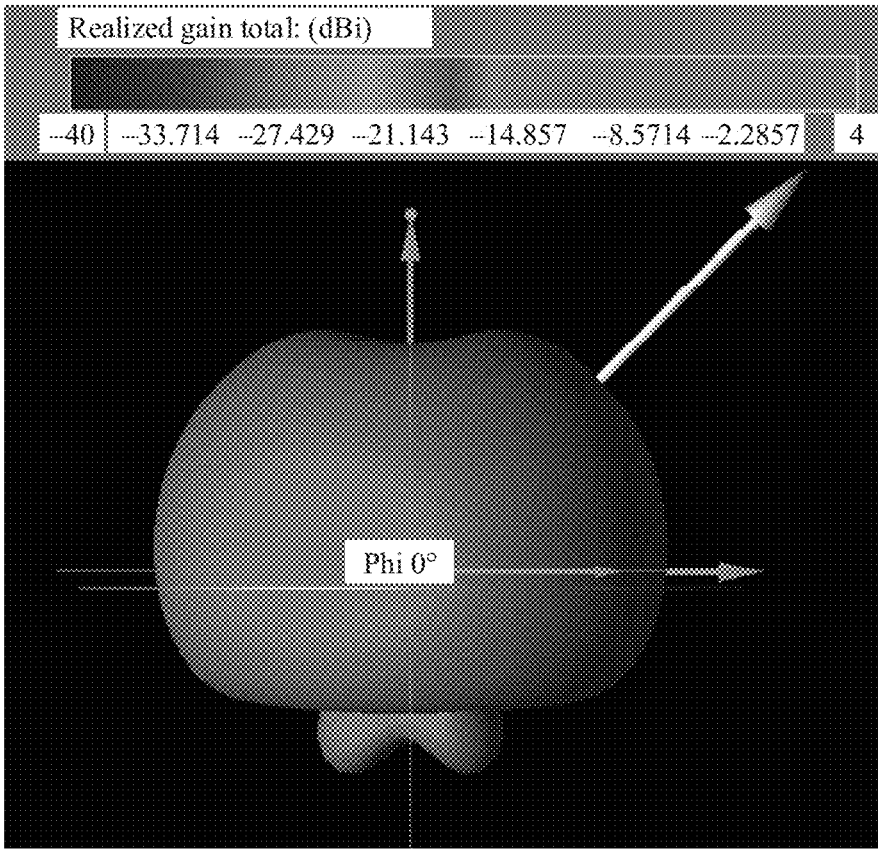

Referring to FIG. 4*h*-1 to FIG. 4*h*-3, in the figures, FIG. 4*h*-1 is a top view of a simulation directivity diagram, FIG. 4*h*-2 is a side view of the simulation directivity diagram, and FIG. 4*h*-3 is a side view of the simulation directivity diagram (vertical to a view angle of FIG. 4*h*-2). After a slot is disposed and a filter is added, a change of current distribution on the ground plate 10 brings a change of a radiation pattern of an antenna in a 2.45 GHz modal, and the radiation pattern of the antenna is pulled down, so that a degree of deviation of a maximum radiation direction of the antenna from a horizontal plane is reduced, and the maximum radiation direction of the antenna is closer to the horizontal plane. This increases a horizontal plane gain.

Figures 1, 4I:
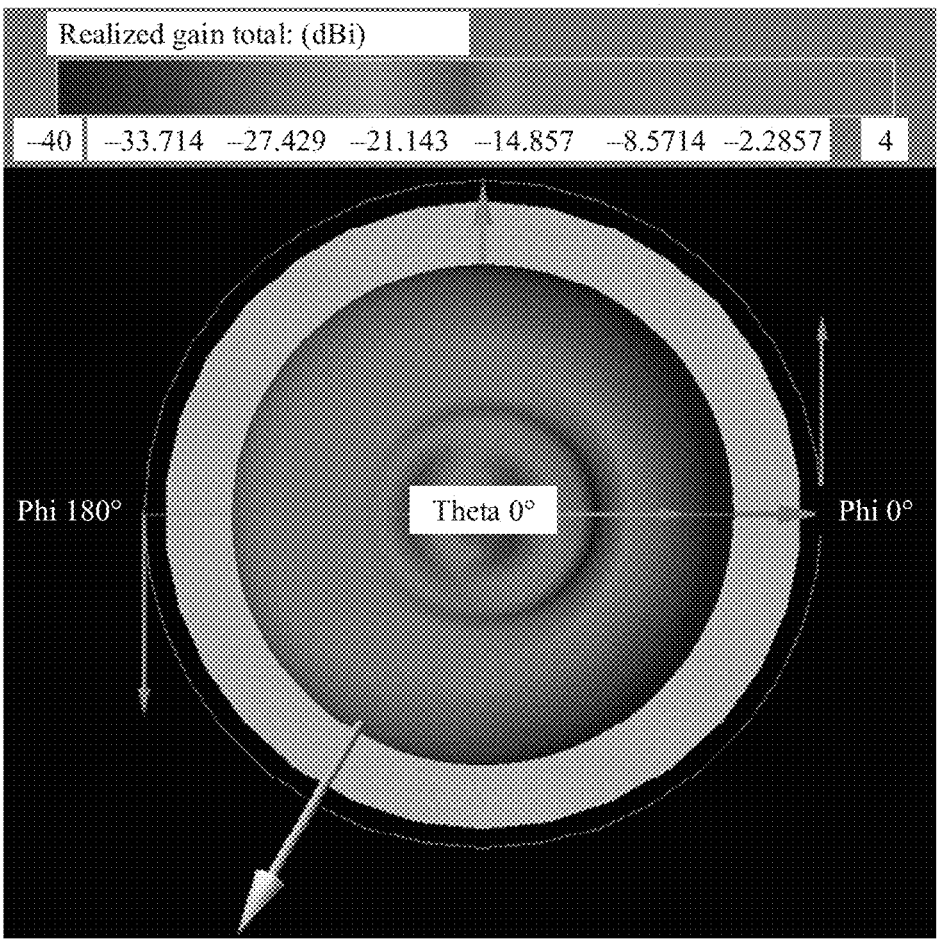
Figures 2, 4I:
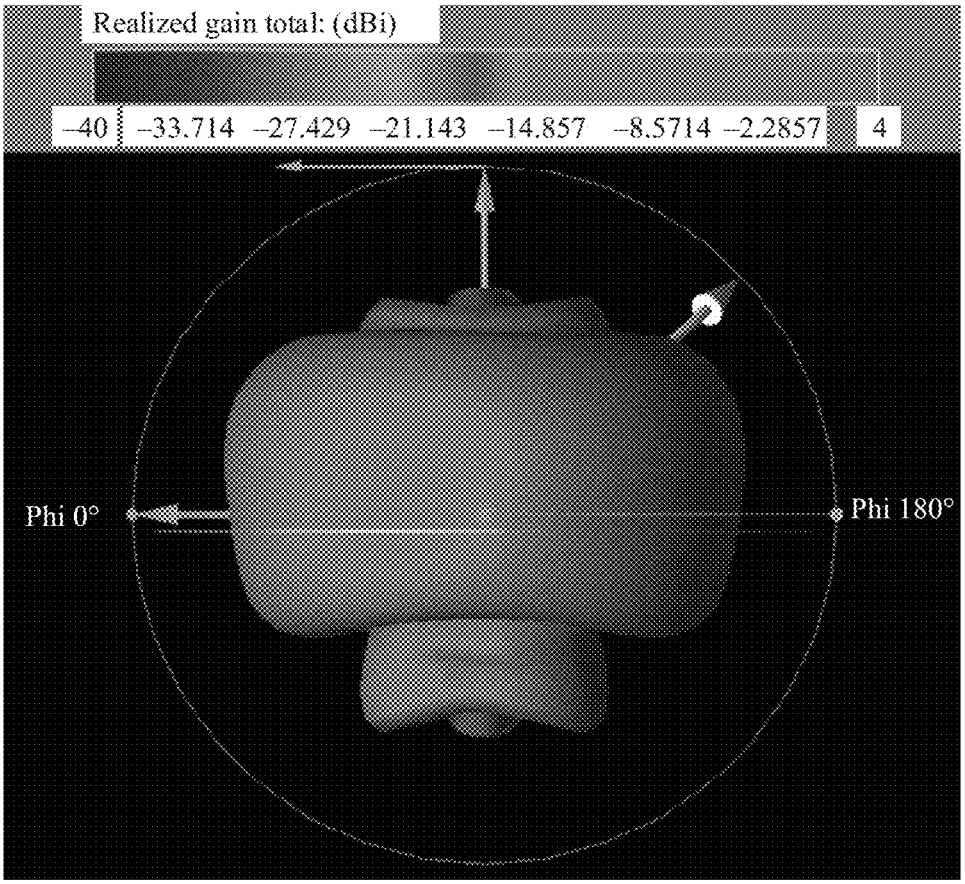
Figures 3, 4I:
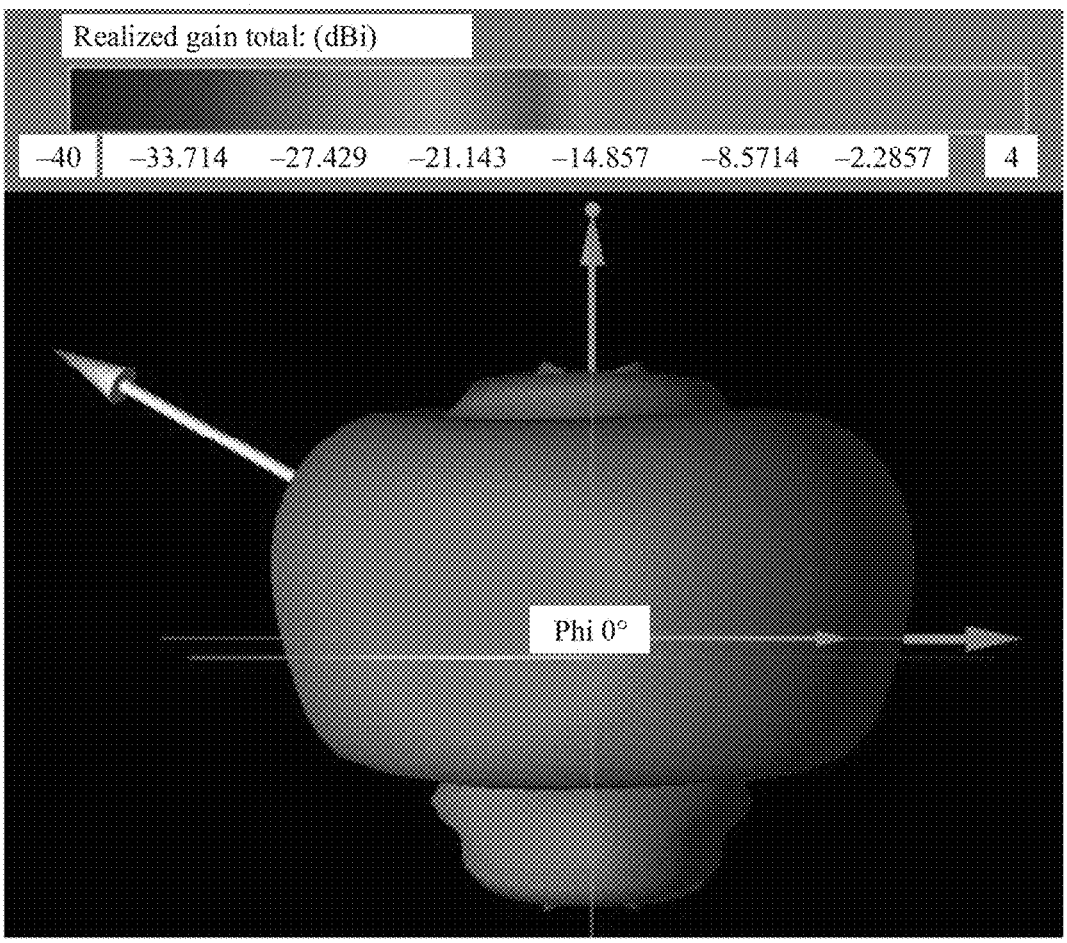

Referring to FIG. 4*i*-1 to FIG. 4*i*-3, in the figures, FIG. 4*i*-1 is a top view of the simulation directivity diagram, FIG. 4*i*-2 is a side view of the simulation directivity diagram, and FIG. 4*i*-3 is a side view of the simulation directivity diagram (vertical to the view of FIG. 4*i*-2). After a slot is disposed and a filter is added, because of a change of current distribution on the ground plate 10, in this way, the 5.9 GHz modal pattern of the antenna is changed, and the pattern of the antenna is pulled down, so that a degree of deviation of the maximum radiation direction of the antenna from the horizontal plane is reduced, and the maximum radiation direction of the antenna is closer to the horizontal plane, thereby increasing a horizontal plane gain.

Figure 4J:
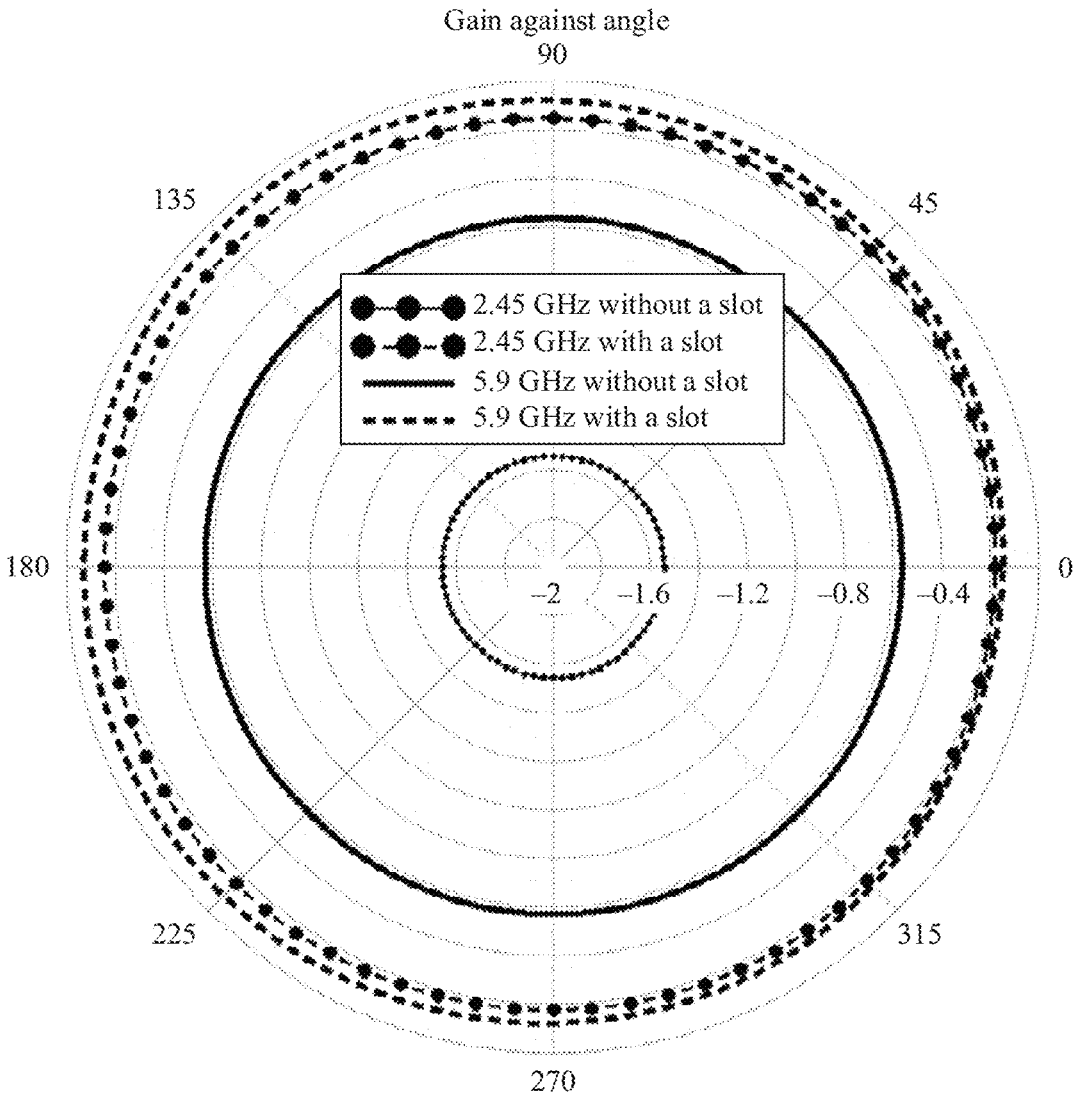
FIG. 4*j* is a schematic comparison diagram of a horizontal plane gain of an antenna apparatus added with a filter, before and after there is a slot in each of a 2.45 GHz modal and a 5.9 GHz modal according to another embodiment.

Referring to FIG. 4*j*, in the figure, a connection line between dots of an inner circle indicates a horizontal plane gain in a 2.45 GHz modal when there is no slot, a connection line between dots of an outer circle indicates a horizontal plane gain in the 2.45 GHz modal after a slot is disposed, a solid line of an inner circle indicates a horizontal plane gain in a 5.9 GHz modal when there is no slot, and a dashed line of an outer circle indicates a horizontal plane gain in the 5.9 GHz modal after a slot is disposed. It can be seen that after the slot is disposed and a filter is added, the horizontal plane gain in the 2.45 GHz modal increases by about 1.3 dB and the horizontal plane gain in the 5.9 GHz modal increases by about 0.5 dB.

What is disclosed above is merely several example embodiments of the present invention, and certainly is not intended to limit the protection scope of the present invention. A person of ordinary skill in the art may understand that all or some of processes that implement the foregoing embodiments and equivalent modifications made in accordance with the claims of the present invention shall fall within the scope of the present invention.

The invention claimed is:

1. An antenna apparatus comprising:

a ground plate;

a radiator disposed on the ground plate;

a signal source coupled to the radiator and configured to feed a first electromagnetic wave signal of a first frequency band into the radiator;

a first slot disposed on the ground plate; and a second slot disposed on the ground plate, wherein both the first slot and the second slot are closed slots and surround the radiator, wherein the first slot and the second slot are configured to restrain a first current distribution on the ground plate, wherein the first slot and the second slot are symmetrically disposed by a joint centered between the radiator and the ground plate, wherein a radial distance from the radiator to the first slot ranges from $0.2x\lambda_1$ to $0.3x\lambda_1$, wherein a first length of the first slot in a radial direction is $0.05x\lambda_1$ and wherein $\lambda_1$ is a first wavelength of the first electromagnetic wave signal.

2. The antenna apparatus of claim 1, wherein the first slot is an arc shape, and wherein a distance between an inner side of the first slot and a center of the radiator is $0.25x\lambda_1$.

3. The antenna apparatus of claim 2, wherein a second length of the first slot extending in a circumference direction is $0.5x\lambda_1$.

4. The antenna apparatus of claim 1, wherein the first frequency band is 5.9 gigahertz (GHz).

5. The antenna apparatus of claim 1, wherein the signal source is further configured to feed a second electromagnetic wave signal of a second frequency band into the radiator, wherein the second frequency band is lower than the first frequency band, wherein the antenna apparatus further comprises a third slot and a fourth slot located on respective peripheries of the first slot and the second slot, wherein both the third slot and the fourth slot are closed slots, and wherein the third slot and the fourth slot are configured to restrain a second current distribution on the ground plate.

6. The antenna apparatus of claim 5, wherein the third slot and the fourth slot are symmetrically disposed by a joint centered between the radiator and the ground plate, wherein a radial distance from the radiator to the third slot ranges from $0.2x\lambda_2$ to $0.3x\lambda_2$, and wherein $\lambda_2$ is a second wavelength of the second electromagnetic wave signal.

7. The antenna apparatus of claim 6, wherein the third slot is an arc shape, and wherein a second distance between an inner side of the third slot and a center of the radiator is $0.25x\lambda_2$.

8. The antenna apparatus of claim 7, wherein a third length of the third slot extending in a circumference direction is $0.5x\lambda_2$.

9. The antenna apparatus of claim 8, wherein a fourth length of the third slot in a radial direction is $0.05x\lambda_1$, and wherein $\lambda_1$ is a first wavelength of the first electromagnetic wave signal.

10. An antenna apparatus comprising:

a ground plate;

a radiator disposed on the ground plate;

a signal source coupled to the radiator and configured to feed electromagnetic wave signals of a first frequency band and a second frequency band into the radiator, wherein the second frequency band is lower than the first frequency band;

a first slot configured to provide two first different electrical lengths and a disposed on the ground plate;

a second slot configured to provide two second different electrical lengths and disposed on the ground plate, wherein both the first slot and the second slot are closed slots and surround the radiator;

a first filter disposed in the first slot in a first manner dividing the first slot into two third slots; and a second filter disposed in the second slot in a second manner dividing the second slot into two fourth slots, wherein the first slot and the second slot are symmetrically disposed by a joint centered between the radiator and the ground plate, wherein a first length of the first slot in a radial direction is $0.05x\lambda_1$, wherein $\lambda_1$ is a wavelength of a first electromagnetic wave signal, wherein a radial distance from the radiator to the first slot ranges from $0.2x\lambda_2$ to $0.3x\lambda_2$, and wherein $\lambda_2$ is a wavelength of a second electromagnetic wave signal.

11. The antenna apparatus of claim 10, wherein both the first filter and the second filter are band-pass filters in which an inductor and a capacitor are coupled in series, and wherein the first filter and the second filter are configured to:

block a first current generated by the first electromagnetic wave signal of the first frequency band; and pass a second current generated by the second electromagnetic wave signal of the second frequency band.

12. The antenna apparatus of claim 10, wherein the first slot is an arc shape, and wherein a distance between an inner side of the first slot and a center of the radiator is $0.25x\lambda_2$.

13. The antenna apparatus of claim 12, wherein a second length of the first slot extending in a circumference direction is $0.5x\lambda_2$.

14. The antenna apparatus of claim 13, wherein the first frequency band is 5.9 gigahertz (GHz), and wherein the second frequency band is 2.45 GHz.

15. A terminal comprising:

a printed circuit board (PCB); and an antenna apparatus comprising:

a ground plate forming a part of the PCB;

a radiator disposed on the ground plate;

a signal source coupled to the radiator and configured to feed a first electromagnetic wave signal of a first frequency band into the radiator;

a first slot disposed on the ground plate; and a second slot disposed on the ground plate, wherein both the first slot and the second slot are closed slots and surround the radiator, wherein the first slot and the second slot are configured to restrain a first current distribution on the ground plate, wherein the first slot and the second slot are symmetrically disposed by a joint centered between the radiator and the ground plate, wherein a radial distance from the radiator to the first slot ranges from $0.2x\lambda_1$ to $0.3x\lambda_1$, wherein a first length of the first slot in a radial direction is $0.05x\lambda_1$, and wherein $\lambda_1$ is a first wavelength of the first electromagnetic wave signal.

16. The terminal of claim 15, wherein the terminal comprises a vehicle.

17. The terminal of claim 16, wherein the antenna apparatus is a vehicle-mounted external antenna.

18. The terminal of claim 15, wherein the signal source is further configured to feed a second electromagnetic wave signal of a second frequency band into the radiator, and wherein the second frequency band is lower than the first frequency band.

19. The terminal of claim 15, wherein the antenna apparatus further comprises a third slot and a fourth slot located on respective peripheries of the first slot and the second slot, wherein both the third slot and the fourth slot are closed slots, and wherein the third slot and the fourth slot are configured to restrain a second current distribution on the ground plate.

20. The terminal of claim 15, wherein the first slot is an arc shape, and wherein a distance between an inner side of the first slot and a center of the radiator is $0.25x\lambda_1$.

* * * * *